US007530765B2

(12) United States Patent
Seo et al.

(10) Patent No.: US 7,530,765 B2
(45) Date of Patent: May 12, 2009

(54) STRUCTURE OF INTERMEDIATE WALL OF THREE ARCH EXCAVATED TUNNEL AND METHOD FOR CONSTRUCTING THE SAME

(75) Inventors: Dong-Hyung Seo, 301-1201 Gangchin-village, 787 Madu-dong, Goyang-shi, 411-350 Gyeonggi-do (KR); Seok-Ryul Yun, Ansan-shi (KR); Oh-Hyun Kwon, Seoul (KR)

(73) Assignee: Dong-Hyung Seo, Goyang-Shi, Gyeonggi-do (KR)

( * ) Notice: Subject to any disclaimer, the term of this patent is extended or adjusted under 35 U.S.C. 154(b) by 336 days.

(21) Appl. No.: 10/534,521

(22) PCT Filed: Nov. 14, 2003

(86) PCT No.: PCT/KR03/02456

§ 371 (c)(1), (2), (4) Date: May 11, 2005

(87) PCT Pub. No.: WO2004/048754

PCT Pub. Date: Jun. 10, 2004

(65) Prior Publication Data

US 2006/0165489 A1 Jul. 27, 2006

(30) Foreign Application Priority Data

Nov. 22, 2002 (KR) ..... 10-2002-0073221

(51) Int. Cl.
*E21D 11/00* (2006.01)

(52) U.S. Cl. ..... 405/150.1; 264/32

(58) Field of Classification Search ..... 405/150.1, 405/132, 150.2; 264/31, 32, 34
See application file for complete search history.

(56) References Cited

U.S. PATENT DOCUMENTS 6,991,402 B2 * 1/2006 Burkhart ..... 405/36

* cited by examiner

*Primary Examiner*—Tara L. Mayo
(74) *Attorney, Agent, or Firm*—Hoffman & Baron, LLP

(57) ABSTRACT

Disclosed are a structure of an intermediate wall of a three arch excavated tunnel, which effectively exhausts subterranean water from a peripheral ground, and a method for constructing the tunnel. The method comprising the steps of: (a) excavating an upper portion of a central tunnel 10; (b) excavating a lower portion of the central tunnel 10; (c) forming an intermediate wall 20 and grouting a gap formed in the intermediate wall 20; (d) excavating an upper portion of a left main tunnel 30; (e) excavating an upper portion of a right main tunnel 40; (f) excavating a lower portion of the left main tunnel 30; (g) excavating a lower portion of the right main tunnel 40; and (h) installing a drain board 50 and a waterproof layer 60 and casting lining concrete 70 therein so that the tunnel is easily drained through drain pipes 65 and residual water pressure is eliminated.

14 Claims, 22 Drawing Sheets

STRUCTURE OF INTERMEDIATE WALL OF THREE ARCH EXCAVATED TUNNEL AND METHOD FOR CONSTRUCTING THE SAME

TECHNICAL FIELD

The present invention relates to a structure of an intermediate wall of a three arch excavated tunnel for subways, trains or roads in downtown areas, in which a plurality of main tunnels are close to each other and through holes are formed through the tunnel so as to reduce damage to the intermediate wall and the ground round when main tunnels are excavated by blasting, and a method for constructing the same, thus reducing a tapered length between a start point and an end point of the subways, trains or roads so that the linearity of the subways, trains or roads is improved, reducing an area of a site for the subways, trains or roads so that economic efficiency of construction is improved, solving a difficulty and a drainage problem caused by a conventional two arch tunnel, and fixedly connecting the intermediate wall to the ground around a ceiling of the tunnel so that the stability of structure is increased.

BACKGROUND ART

Recently, large-scaled roads such as beltline highways have been constructed around metropolitan regions in order to meet an increased traffic volume. Further, there have been required designs of the roads for minimizing right of way in order to meet recent requirements of a tunnel having a large cross-section and increased price of land.

Moreover, since a large portion of Korea is mountainous, there have been required tunnel-bridge structures so as to improve linearity of roads and obtain good linearity of roads in designing the roads.

A conventional tunnel having total four lanes is designed such that an up-tunnel and a down-tunnel are spaced from each other by a distance of 30 m or more in consideration of arching of an original ground, thus requiring an excessively large area for constructing the tunnel.

In case that the conventional tunnel is designated such that two tunnels, i.e., the up-tunnel and the down-tunnel, are close to each other, pillars are installed between the two tunnels. The pillars have a reduced stability due to water leakage from a ceiling area of the tunnel and the occurrence of freezing in the winter season. These phenomena occur due to failure of drainage at a low point of an upper end of an intermediate area of the two main tunnels.

That is, as shown in FIG. 2*a*, which is a schematic cross-sectional view of a conventional pillar-supporting type two arch tunnel, the conventional pillar-supporting type two arch tunnels comprises pillars for supporting the tunnel are installed between two main tunnels, thus having a weak structure. Further, the conventional pillar-supporting type two arch tunnel comprises drain pipes respectively installed in the pillars so that subterranean water contained in the ground around an upper portion of the tunnel is eliminated therethrough. However, the subterranean water is gathered in low-level areas (low points) of the ceiling area and is not easily drained, thus generating subterranean water leakage and whitening the surface of the areas.

When the pillars are constructed from concrete, the pillars must be constructed such that respective portions of the pillars, i.e., base portions, wall portions and upper haunch portions, are divisionally constructed. Thus, the conventional tunnel is disadvantageous in that the number of constructing steps is increased and a long construction period is taken.

Further, since the pillars of the conventional tunnel are separated from the ceiling area by a waterproof layer, the pillars are fixed to the tunnel not by hinges or fixing points but by free terminals and the filling of a grout material is incompletely performed.

As shown in FIG. 2*b*, which is an assembled cross-sectional view of reinforcing bars of an intermediate wall of a conventional three arch excavated tunnel, construction of clamp joint steels between the intermediate wall and lining concrete causes complexity in installing a mold and placing concrete and a difficulty in construction, thus deteriorating quality of the pillars when the concrete is placed.

Further, when main tunnels of the conventional tunnel are excavated by blasting, a vibration damping method for protecting the ground located at top portions of the pillars is not applied. Accordingly, the excavation of the conventional tunnel easily damages the ground.

DISCLOSURE OF THE INVENTION

Therefore, the present invention has been made in view of the above problems, and it is an object of the present invention to provide a structure of an intermediate wall of a three arch excavated tunnel, in which a separation distance between two main tunnels is maximally reduced in consideration of an arching effect of a conventional twin tunnel, and a method for constructing the three arch excavated tunnel, thus reducing the area of a site required for a road, solving problems caused by the conventional tunnel, and reducing construction period and construction cost.

It is another object of the present invention to provide a structure of an intermediate wall of a three arch excavated tunnel, which improves drainage from the ground around the tunnel, and a method for constructing the three arch excavated tunnel.

In accordance with the present invention, a central excavation tunnel is excavated in advance so as to perform subsurface exploration of the ground around the tunnel, i.e., supporting capacity, and to determine an excavation method prior to excavation of main tunnels, and an intermediate wall is installed at a central area of the central exploration tunnel so as to support one side surface of each of the main tunnels. Further, in accordance with the present invention, the intermediate wall is more efficiently constructed such that the ground around the tunnel is easily drained. Moreover, in accordance with the present invention, there are proposed an iron mold moving along rails installed at both sides of the intermediate wall, and a protective wire netting frame for protecting the intermediate wall when the main tunnels are excavated by blasting.

In accordance with one aspect of the present invention, the above and other objects can be accomplished by the provision of a method for constructing a three arch excavated tunnel comprising the steps of: (a) excavating an upper portion of a central tunnel; (b) excavating a lower portion of the central tunnel; (c) forming an intermediate wall by assembling reinforcing bars passing through the central tunnel and by placing concrete therein, and grouting a gap formed on an upper end of the intermediate wall and a ceiling portion of the central tunnel; (d) excavating an upper portion of a left main tunnel; (e) excavating an upper portion of a right main tunnel; (f) excavating a lower portion of the left main tunnel; (g) excavating a lower portion of the right main tunnel; and (h) installing a drain board and a waterproof layer along inner side surfaces of the intermediate wall and the left and right main tunnels and casting lining concrete therein so that low points collecting water are not formed on the intermediate wall, thus allowing the tunnel to be easily drained through the drain board and drain pipes and residual water pressure to be eliminated.

In accordance with a further aspect of the present invention, there is provided a structure of an intermediate wall of a three arch excavated tunnel, in which a drain board and a waterproof layer are located on side walls of the intermediate wall, and then lining concrete is cast onto the side walls of the intermediate wall.

In accordance with another aspect of the present invention, there is provided a method for constructing an intermediate wall of a three arch excavated tunnel, in which a iron mold including an H-shaped section for forming an external portion, a streamline steel plate for forming an internal portion, and a supporting truss angle beam installed between the H-shaped section and the streamline steel plate is manufactured, and concrete is cast once into a space between the H-shaped section and the streamline steel plate through the mold so as to form the intermediate wall from a base to a top (one lot each one time) in a designated section.

Preferably, the iron mold may move along rails installed at both sides of the intermediate wall in a longitudinal direction of the tunnel, thus continuously casting and constructing the intermediate wall at every section.

Further, preferably, a vibrator may be installed adjacent to the streamline steel plate of the iron mold when the concrete is cast at every section, thus allowing the concrete to be firmly cast.

Moreover, preferably, a protective wire netting frame provided with rollers installed at a lower end may move within a blasting section along rails used in constructing the intermediate wall for preventing the intermediate wall from being damaged when left and right main tunnels are excavated by blasting after the construction of the intermediate wall.

In accordance with another aspect of the present invention, there is provided an iron mold comprising: an H-shaped section for forming an external portion; a streamline steel plate for forming an internal portion; a supporting truss angle beam installed between the H-shaped section and the streamline steel plate; and rollers installed at a lower end, wherein the iron mold moves along rails installed at both sides of an intermediate wall.

In accordance with another aspect of the present invention, there is provided a protective wire netting frame comprising: a wire netting forming an external portion; a truss angle forming an internal portion; a supporting truss angle beam installed between the wire netting and an H-shaped section; and rollers installed at a lower end.

In accordance with still another aspect of the present invention, there is provided a method for excavating a multi-arch tunnel, in which two central tunnels are excavated, intermediate walls for respectively supporting ceiling portions of the central tunnels are installed, and then a left main tunnel, a right main tunnel and an intermediate main tunnel are excavated.

In accordance with yet another aspect of the present invention, there is provided a method for constructing an intermediate wall, having an upper fixing type structure, of a three arch excavated tunnel, in which lining concrete is cast and fixed to an upper side of the intermediate wall, a lower portion of the intermediate wall has a small thickness reduced as much as the thickness of the lining concrete, and the lower portion of the intermediate wall is one type selected from the group consisting of a column type, an arch type and an intermediate wall type.

Preferably, the intermediate wall having the upper fixing type structure may be one selected from the group consisting of a cast-in-place type intermediate wall, a steel plate girder type intermediate wall and a precast concrete type intermediate wall.

Further, preferably, the steel plate girder type or the precast concrete type intermediate wall may have a drainage system in which a portion of the intermediate wall penetrating a central tunnel is filled with a grouting agent without application of a waterproofing step, and an upper portion of the intermediate wall is drained such that water is induced toward side walls of the intermediate wall using a drain board and a waterproof layer and then sequentially flows toward the inside of the intermediate wall along a collection tank stopper, a collection tank and drain pipes.

Moreover, preferably, the steel plate girder type intermediate wall may have a drainage system in which the intermediate wall is drained such that water from the intermediate wall sequentially flows toward the outside of the intermediate wall along a collection tank stopper, a collection tank and drain pipes.

Preferably, the cast-in-place type intermediate wall may have a drainage system in which a cross section of the intermediate wall is locally reduced or cut so that water induced into the side surfaces of the cast-in-place type intermediate wall flows along openings and then comes down.

Further, preferably, a head of the intermediate wall may be respectively fixed to the ground around a ceiling portion of the intermediate wall penetrating the central tunnel so that the intermediate wall has an effective structure, and designated portions of lock bolts having a length corresponding to length joints may be exposed in advance and then buried into the head of the intermediate wall when the lock bolts are screwed into the ceiling portion of the intermediate wall.

Moreover, preferably, studs may be installed in advance in a head of the steel plate girder type or the precast concrete type intermediate wall, concrete may be cast into spaces formed by exposing lock bolts, and the spaces may be filled with mortar and a milk grouting agent.

Preferably, pipe holders and utility pipes may be installed in the steel plate girder type or precast concrete type intermediate wall, thus allowing cables for communication and electric wires to pass through the intermediate wall.

In accordance with still yet another aspect of the present invention, there is provided a method for constructing an intermediate wall of a three arch excavated tunnel, in which through holes are formed for damping vibration before left and right main tunnels are excavated by blasting, thus preventing the ground around a ceiling portion of the intermediate wall from being damaged when the left and right main tunnels are excavated by blasting.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be described in detail with reference to the annexed drawings. However, the following description does not limit the subject matter of the present invention.

Figure 1A:
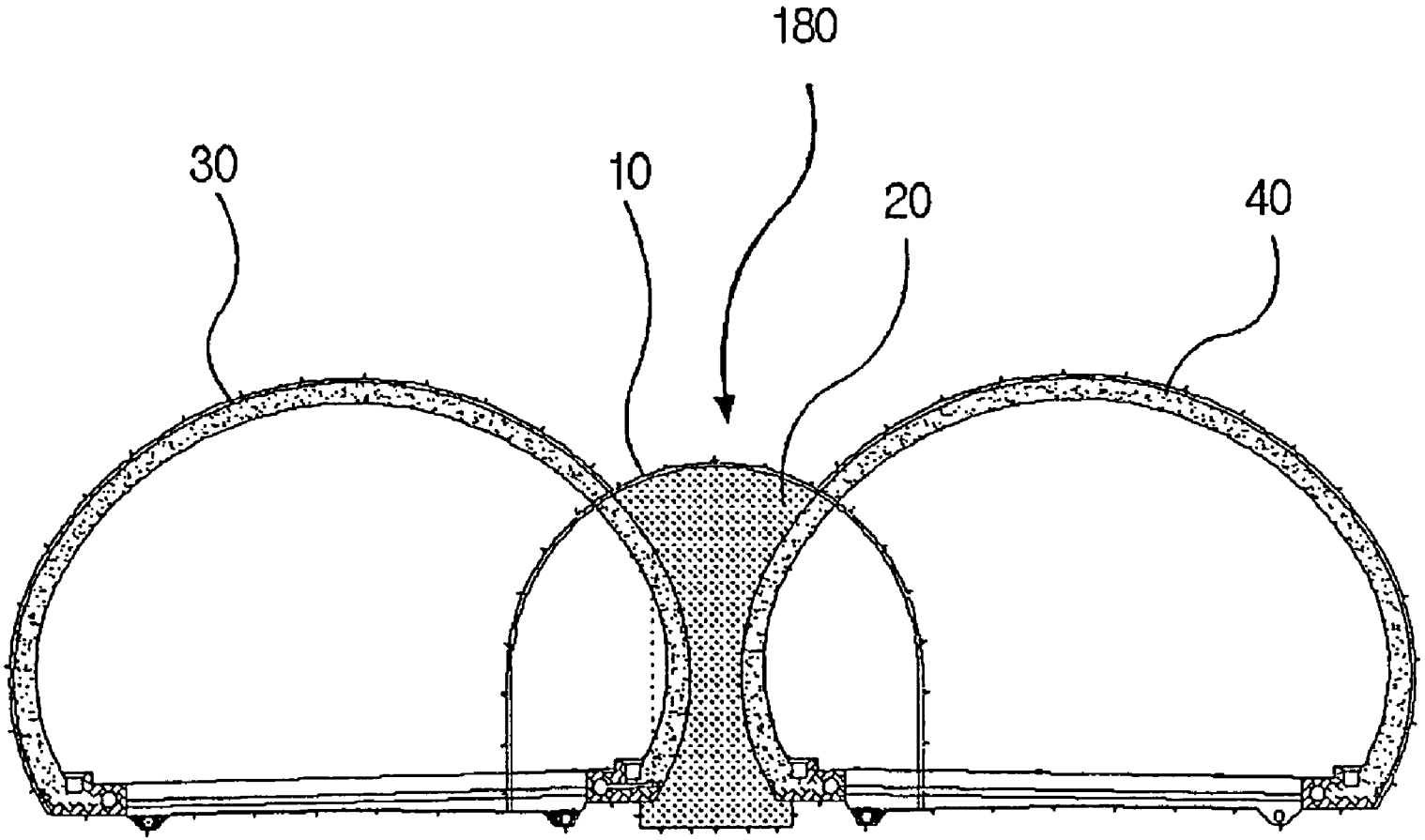
FIG. 1*a* is a schematic cross-sectional view of a three arch excavated tunnel in accordance with the present invention.
Figure 1B:
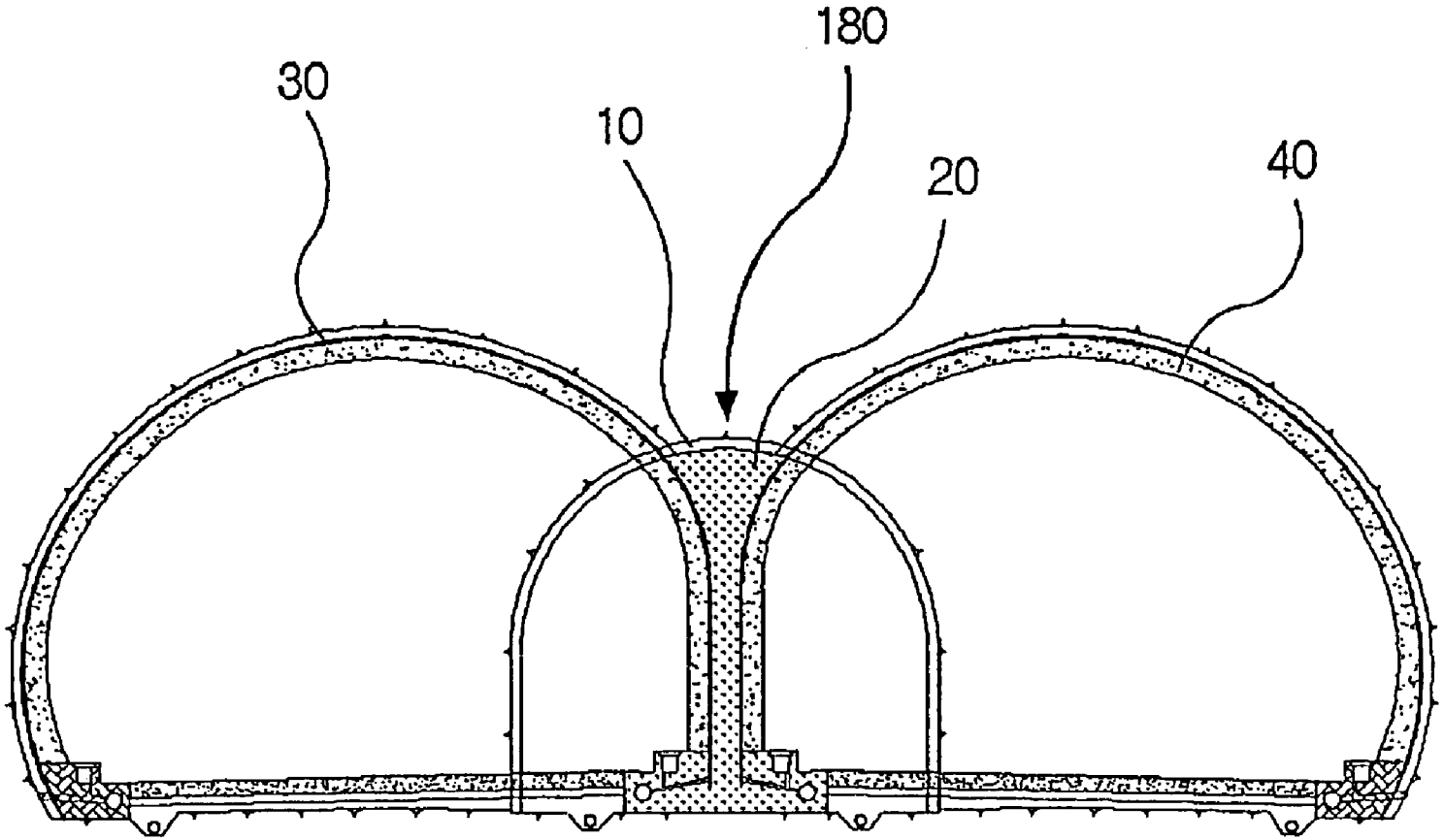
FIG. 1*b* is a cross-sectional view of a three arch excavated tunnel comprising an intermediate wall having a straight line shape.
Figure 3:
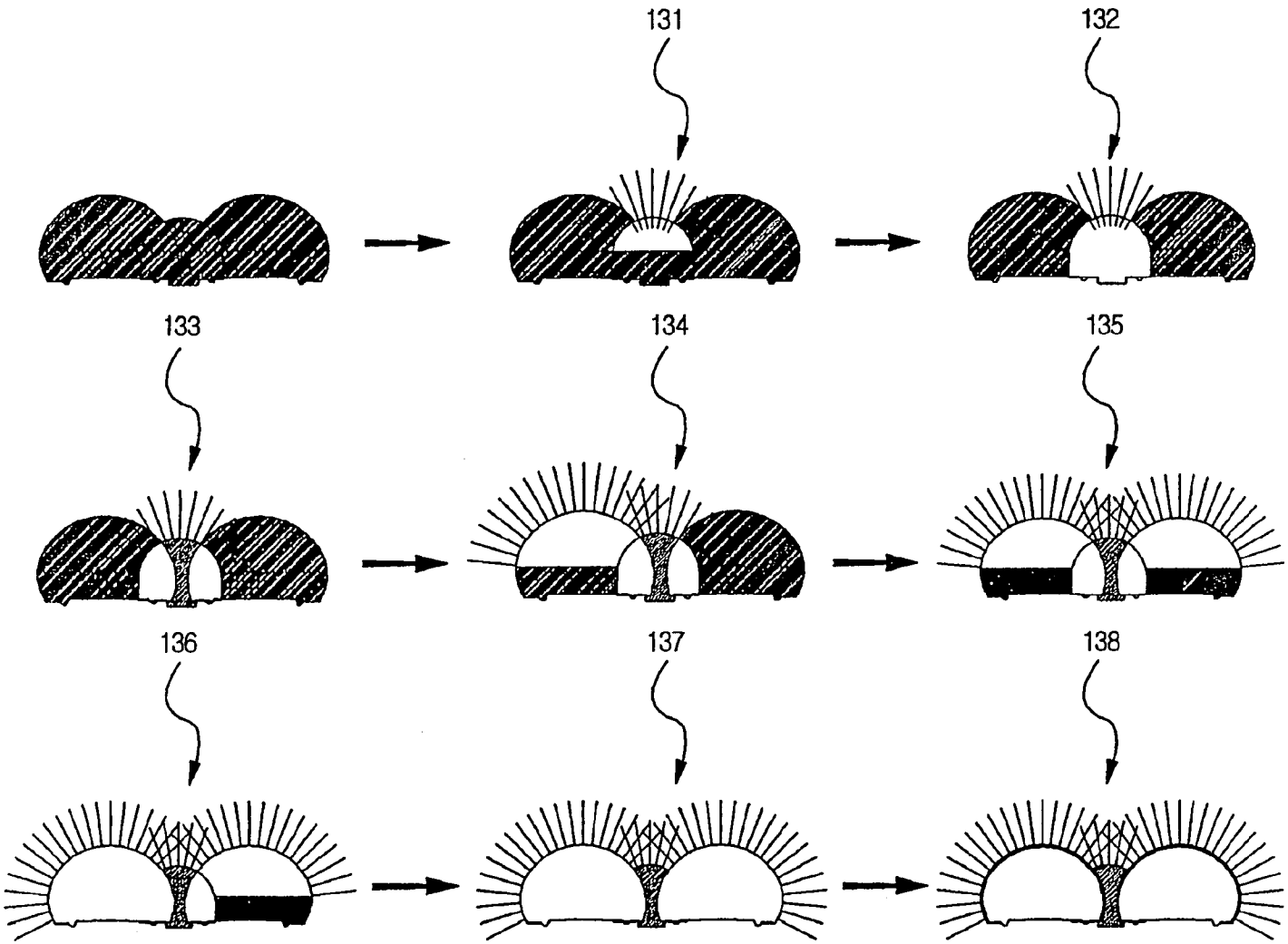
FIG. 3 schematically illustrates a process for constructing a three arch excavated tunnel in accordance with the present invention.

FIGS. 1*a* and 1*b* illustrate a three arch excavated tunnel constructed by a method in accordance with the present invention. As shown in FIG. 3, a method for constructing the three arch excavated tunnel sequentially comprises a step 131 for excavating an upper portion of a central tunnel 10, a step 132 for excavating a lower portion of the central tunnel 10, a step 133 for forming an intermediate wall 20 by assembling reinforcing bars passing through the central tunnel 10 and by placing concrete therein, and grouting a gap formed on an upper end of the intermediate wall 20 and a ceiling portion of the central tunnel 10, a step 134 for excavating an upper portion of a left main tunnel 30, a step 135 for excavating an upper portion of a right main tunnel 40, a step 136 for excavating a lower portion of the left main tunnel 30, a step 137 for excavating a lower portion of the right main tunnel 40, and a step 138 for installing a drain board 50 and a waterproof layer 60 along inner walls of the left and right main tunnels 30 and 40 and placing lining concrete 70 therein. Here, a method for constructing a conventional tunnel (two arch tunnel) comprises the above-described steps 131 to 137.

Figure 5:
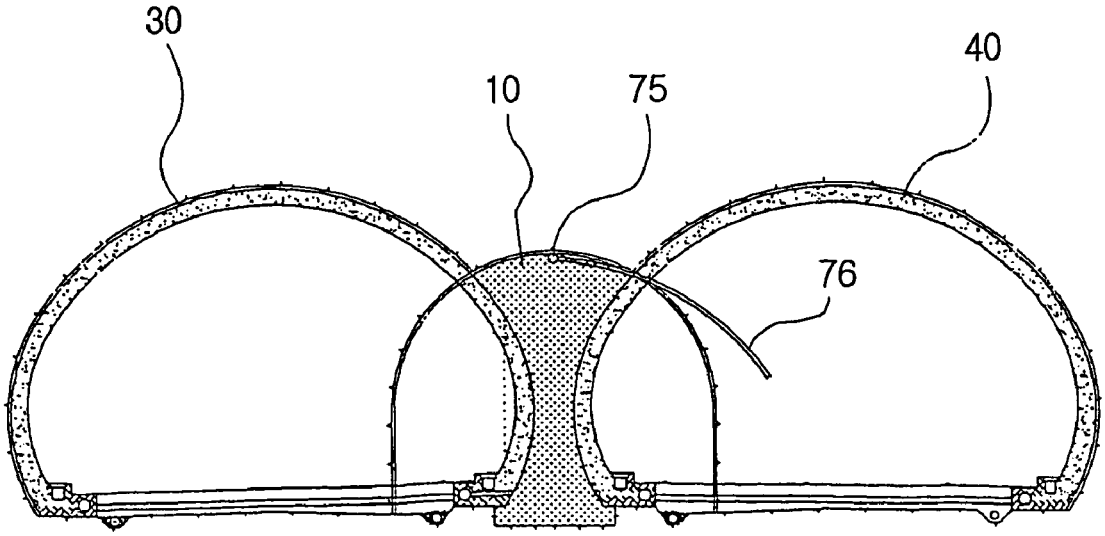
FIG. 5 is a cross-sectional view of the three arch excavated tunnel, in which a top portion of an intermediate wall is grouted, in accordance with the present invention.

The intermediate wall 20 is constructed such that connecting joints are located at suitable positions in a longitudinal direction of the tunnel, and contraction and expansion joints are arranged in the intermediate wall by an internal of 20 m to 40 m so as to control cracks formed in concrete. There is generated a gap between the intermediate wall 20 and the ceiling area due to contractibility of concrete occurring during a curing period. Accordingly, as shown in FIG. 5, a plurality of grouting perforated pipes 75 and grouting connecting horses 76 having a total length of 4 m to 7 m are installed in a longitudinal direction of the intermediate wall 20, thus performing cement milk grouting using an expansion agent and an accelerating agent.

Figure 2A:
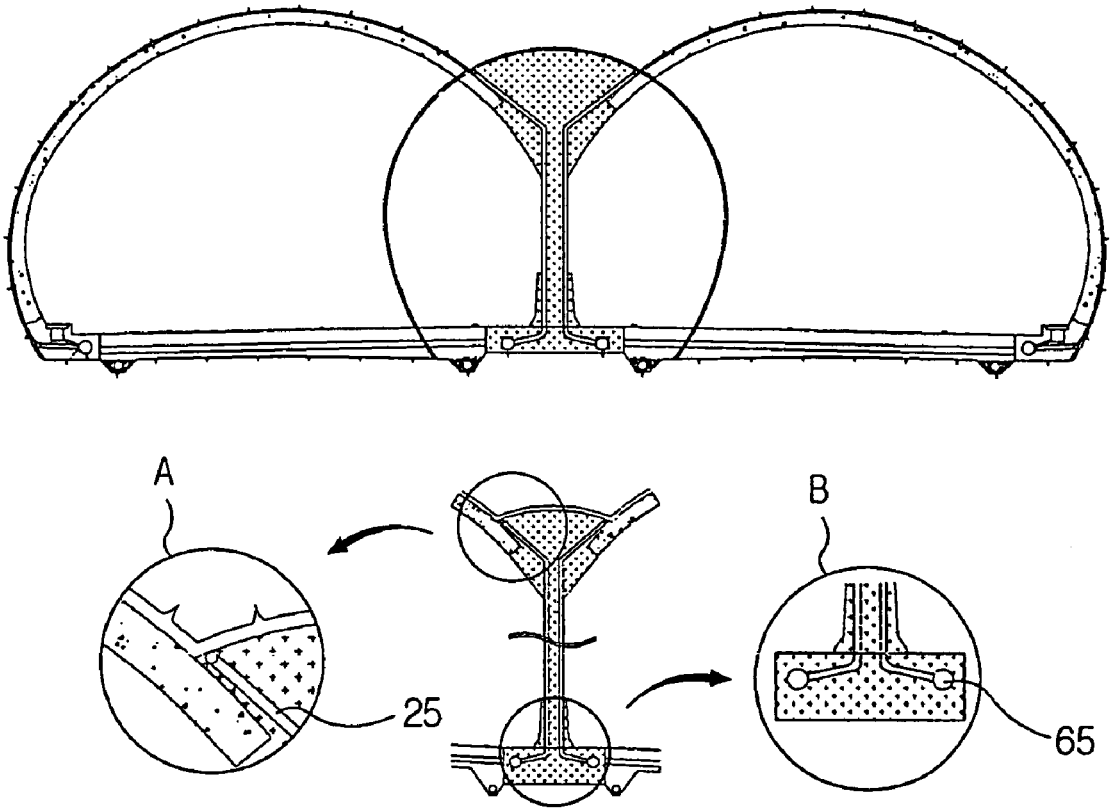
FIG. 2*a* is a schematic cross-sectional view of a conventional pillar-supporting type tunnel (two arch tunnel)
Figure 2B:
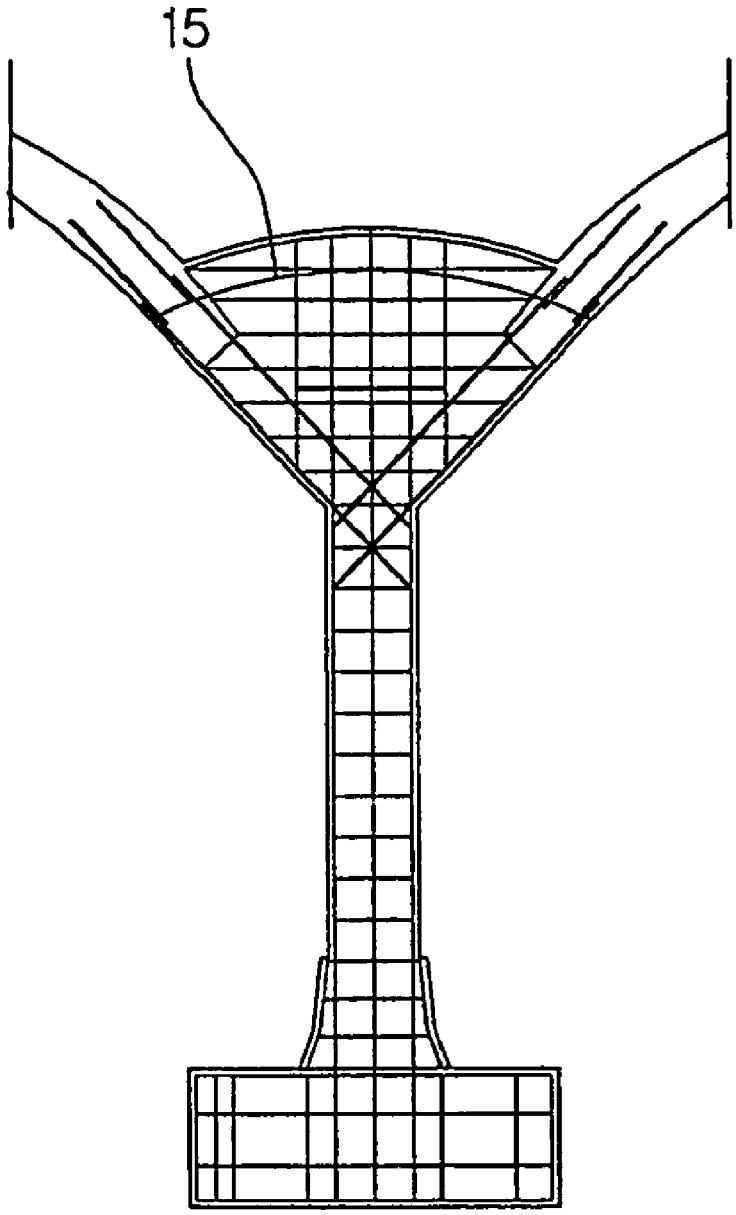
FIG. 2*b* is an assembled cross-sectional view of reinforcing bars of a pillar of the conventional tunnel.
Figure 4A:
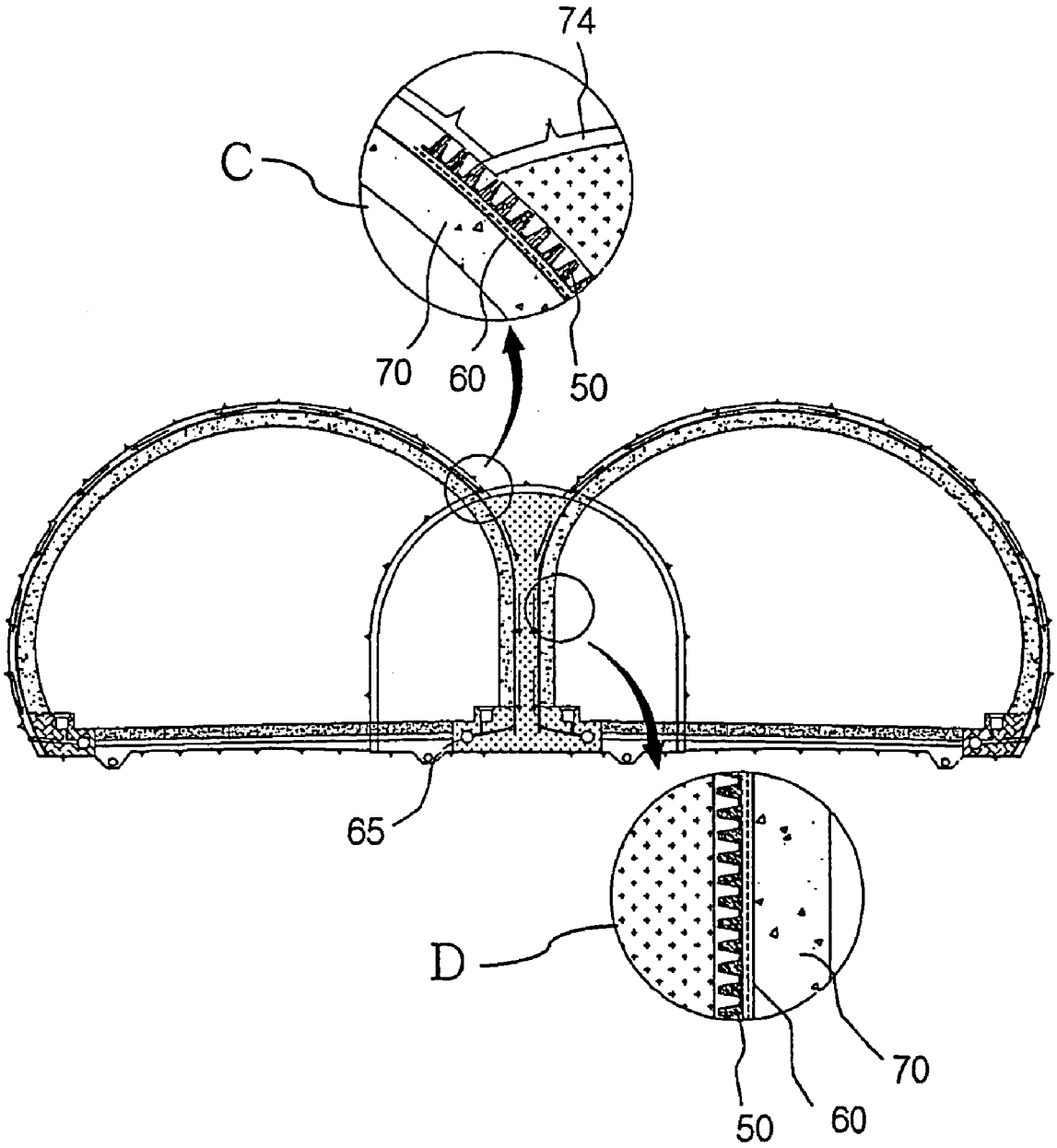
FIG. 4*a* is a schematic cross-sectional view of a drainage system of the three arch excavated tunnel comprising an intermediate wall, having a straight shape and a lower fixing type structure in which lining concrete is attached to a lower end of the intermediate wall, in accordance with the present invention.
Figure 4B:
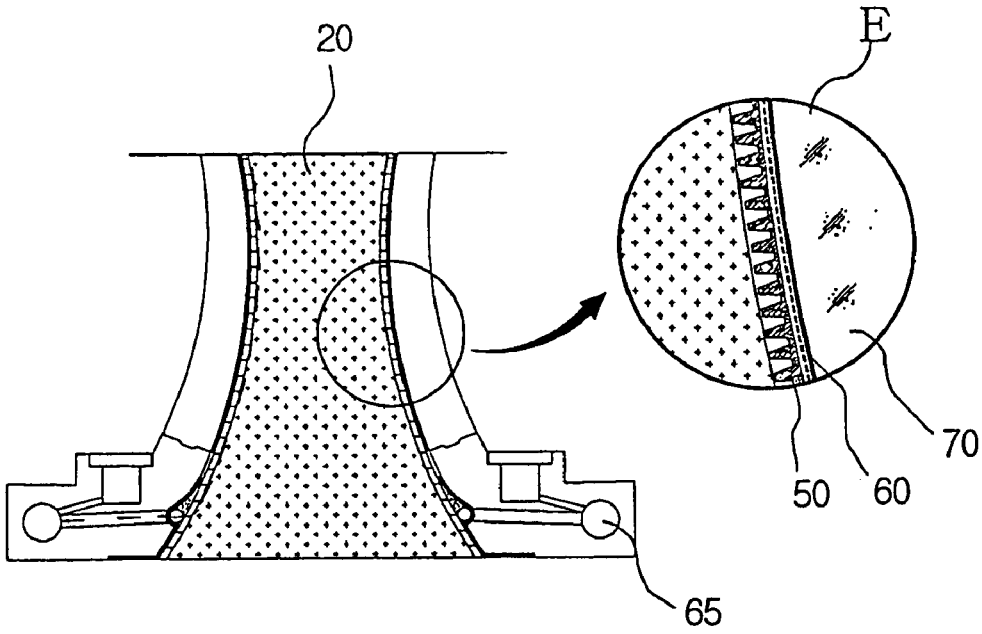
FIG. 4*b* is a schematic cross-sectional view of a drainage system of the three arch excavated tunnel comprising an intermediate wall, having an arch shape and a lower fixing type structure in which the lining concrete is attached to the lower end of the intermediate wall, in accordance with the present invention.

The shape of the intermediate wall 20 is an important matter of the present invention in relation to drainage of the peripheral ground. The conventional tunnel comprises central walls for supporting the tunnel installed between two main tunnels, thus having a weak structure. Further, as shown in FIGS. 2*a* and 2*b*, the conventional tunnel comprises drain pipes 25 respectively installed in the intermediate walls so that subterranean water contained in the ground around an upper portion of the tunnel is eliminated therethrough. However, the subterranean water is gathered in low-level areas (low points) of the ceiling area and is not easily drained, thus generating subterranean water leakage and whitening surfaces of the areas. In order to solve the above problems of the conventional tunnel, as shown in FIGS. 4*a* and 4*b*, after the excavation of the left and right main tunnels 30 and 40 provided with the intermediate wall 20, the drain board 50 is interposed between an excavated section of each of the left and right main tunnels 30 and 40 and the intermediate wall 20, the waterproof layer 60 is attached to the drain board 50, and then the lining concrete 70 is placed onto the waterproof layer 60, thus allowing subterranean water contained in the ground around the upper portion of the tunnel to be guided into a drain pipe 65 through the drain board 50 and solving the problems generated due to subterranean water leakage. The above-described drainage principle is applied to the intermediate wall 20 having an upright shape as well as a rounded shape. In case that the intermediate wall 20 has the upright shape, the structure of the lining concrete 70 corresponds to this shape of the intermediate wall 20.

Figure 6:
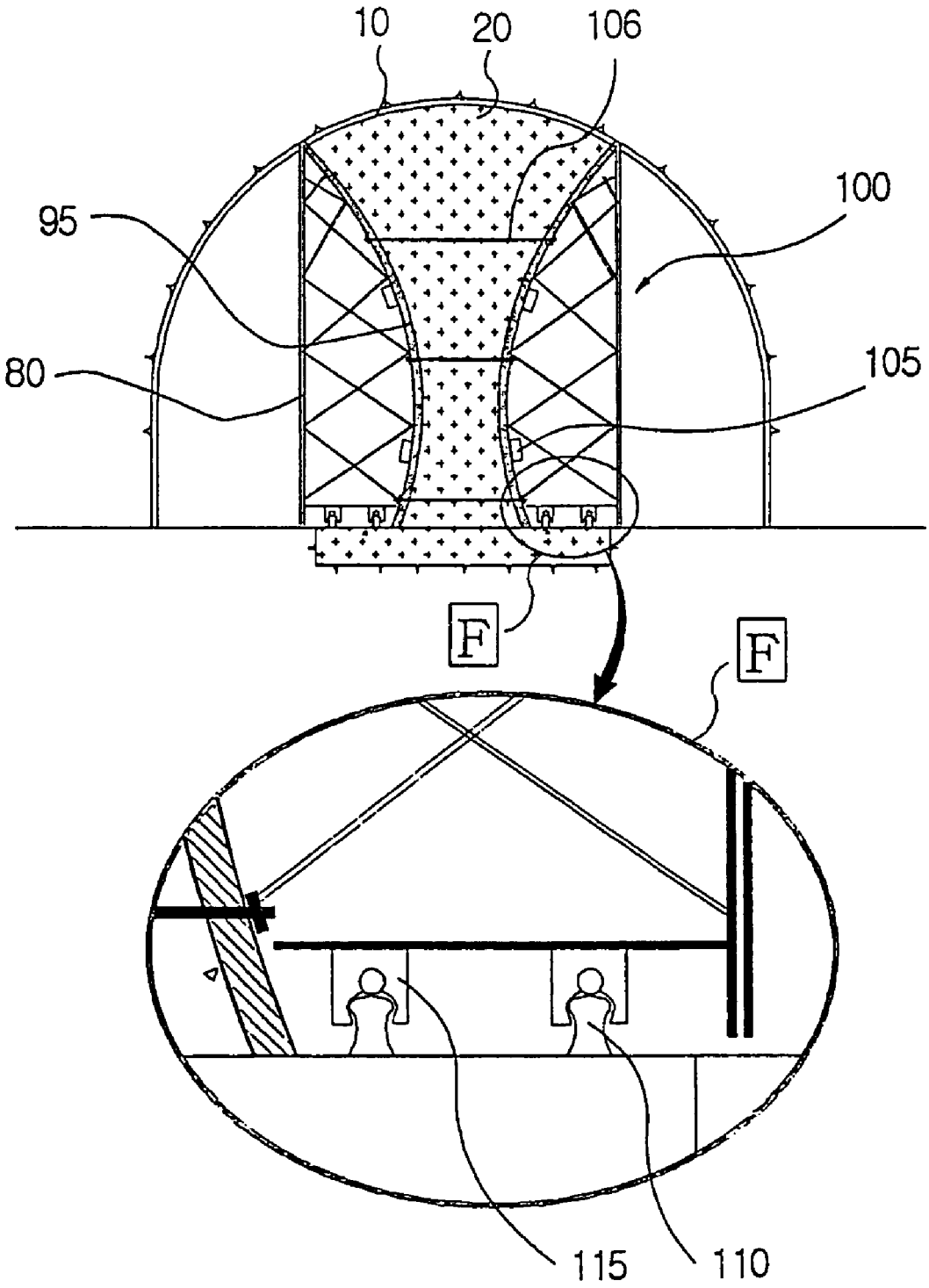
FIG. 6 is a schematic cross-sectional view of an iron mold used for constructing an intermediate wall of the three arch excavated tunnel in accordance with the present invention.

As shown in FIG. 6, an iron mold 100 20 which includes an H-shaped section 80 forming an external portion, a streamline steel plate 95 forming an internal portion, a supporting truss angle beam 85 installed between the H-shaped section 80 and the streamline steel plate 95, and rollers 115 at its lower end, continuously moves along rails 110 installed at both sides of the intermediate wall 20, and the intermediate wall 20 is constructed by assembling reinforced rods and then by casting concrete therein. The above-described iron mold 100 is manufactured so as to have a suitable length along a longitudinal direction of the tunnel, and is movable along the rails 110. The iron mold 100 is designed such that form ties 106 at both sides are fixed to each other, thus enduring a pressure generated in casting concrete. After the installation of the iron mold 100, a total of 8 vibrators 105 for hardening the cast concrete are respectively installed at upper, lower and both side portions of the intermediate wall 20, thus allowing the cast concrete to be firmly hardened.

Figure 7:
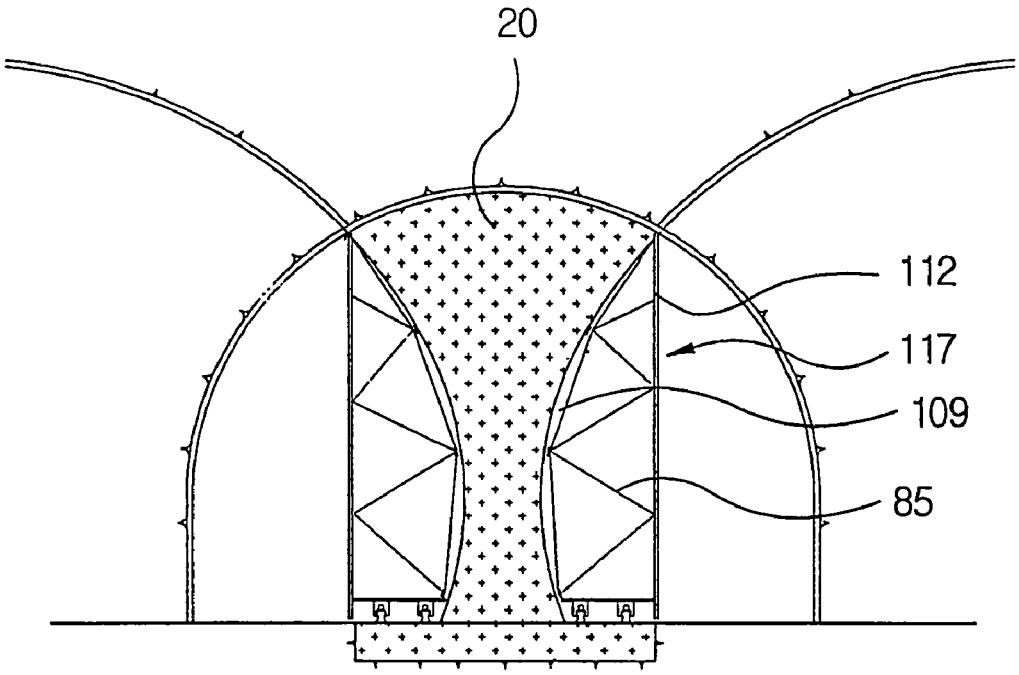
FIG. 7 is a schematic cross-sectional view of a protective wire netting frame for protecting an intermediate wall when main tunnels are excavated by blasting after the construction of the intermediate wall.
Figure 8:
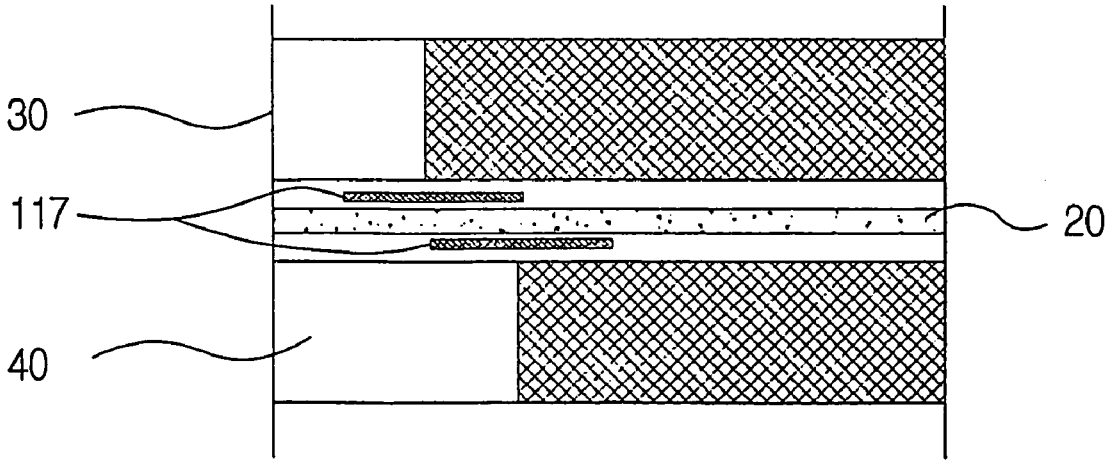
FIG. 8 is a plan view illustrating the movement of the protective wire netting frame along a blasting section in order to protect the intermediate wall when the main tunnels are constructed by blasting.

As shown in FIGS. 7 and 8, a protective wire netting frame 117 for preventing the intermediate wall 20 from being damaged when the left and right main tunnels 30 and 40 are excavated by blasting after the construction of the intermediate wall 20 uses the rails 110 used in constructing the intermediate wall 20. That is, the protective wire netting frame 117, which includes a wire netting 112 forming an external portion, a truss angle forming an internal portion, the supporting truss angle beam 85 installed between the wire netting 112 and the H-shaped section 80, and the rollers 115 installed at a lower end, moves along rails 110 within a blasting section, thus protecting the intermediate wall 20 from vibration generated when the left and right main tunnels are blasted.

The intermediate wall 20 in accordance with the present invention is divided into three types, i.e., an intermediate wall type, an arch type and a column type. Hereinafter, a lower portion of the intermediate wall denotes a base of the intermediate wall and an upper portion of the intermediate wall denotes a triangular portion of a head of the intermediate wall.

As shown in FIGS. 1*a*, 1*b*, 4*a* and 4*b*, a lower fixing type structure denotes a structure in which lining concrete is cast and attached to a lower end of the intermediate wall, and as shown in FIGS. 9*a*, 9*b*, 9*c*, 9*d*, 9*e*, 13 and 14, an upper fixing type structure denotes a structure in which the lining concrete is cast and attached to an upper end of the intermediate wall, i.e., a triangular portion of a head of the intermediate wall.

The above upper fixing type structure is designed such that the lining concrete 70 is cast and attached to the triangular portion of the head of the intermediate wall, and a drainage system of the upper fixing type structure is designed such that water is induced to be discharged from a portion of the intermediate wall provided with the lining concrete 70 including the drain board 50 and the waterproof layer 60 is induced to be drained and then flows along the drain pipes 25 or side walls 186 in a portion of the intermediate wall, located below the above portion.

That is, the intermediate wall 20 having the upper fixing type structure is constructed such that the lining concrete is cast and fixed to an upper side of the intermediate wall 20, i.e., the triangular portion of the head of the intermediate wall, and a lower portion of the intermediate wall 20 has a small thickness reduced as much as the thickness of the lining concrete 70. Here, the lower portion of the above intermediate wall 20 has one type selected from the group consisting of a column type, an arch type and an intermediate wall type.

Further, the intermediate wall having the upper fixing type structure is divided into three types, such as a cast-in-place type intermediate wall 130, a steel plate girder type intermediate wall 140, and a precast concrete type intermediate wall 150.

Figure 10:
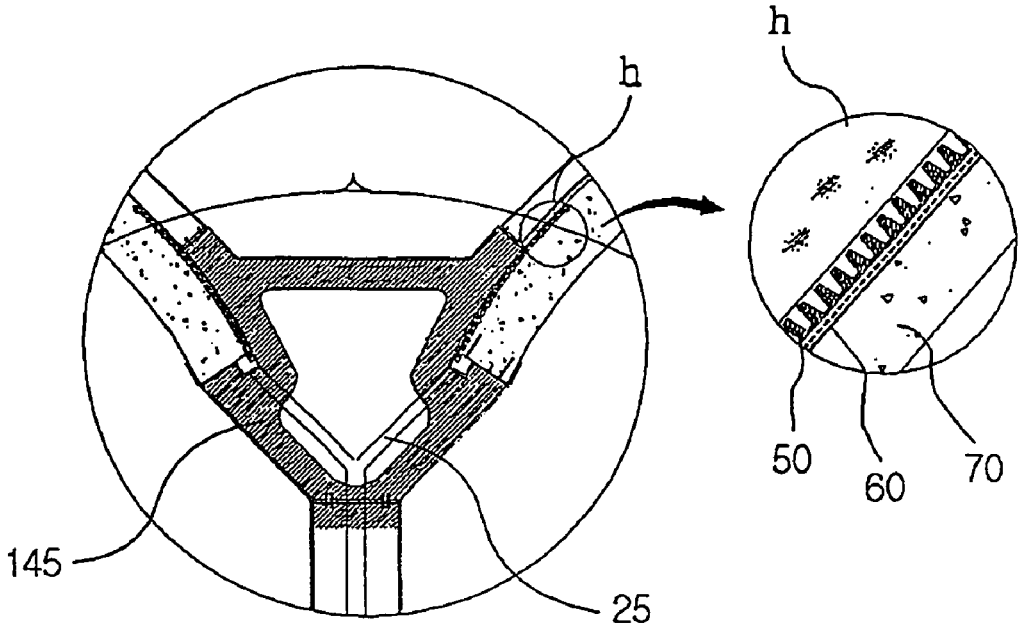
FIG. 10 is a schematic view of a multi-arch tunnel comprising a plurality of main tunnels having an upper fixing type structure in which lining concrete is attached to an upper end of an intermediate wall.

As shown in FIG. 10 illustrating a multi-arch tunnel comprising a plurality of main tunnels having an upper fixing type structure in which lining concrete is attached to an upper end of an intermediate wall, by using the same excavation principle as that for constructing the three arch tunnel, two central tunnels 10 are first excavated, and then the intermediate walls 20 for respectively supporting the ceiling areas of the central tunnels 10 are installed. Thereafter, the left main tunnel 30, the right main tunnel 40 and an intermediate main tunnel 55 are excavated.

Hereinafter, a drainage system of the steel plate girder type intermediate wall 140 of the upper fixing type structure will be described in detail. The side walls and the ceiling area 180 of the intermediate wall 140 are filled with a grouting agent without application of a waterproof layer, and the upper portion of the intermediate wall 140 is drained such that water is induced toward the side surfaces of the intermediate wall 140 using the drain board 70 and the waterproof layer 60 and then sequentially flows toward the inside of the intermediate wall 140 along a collection tank stopper 142, a collection tank 141 and the drain pipes 25.

Figure 11A:
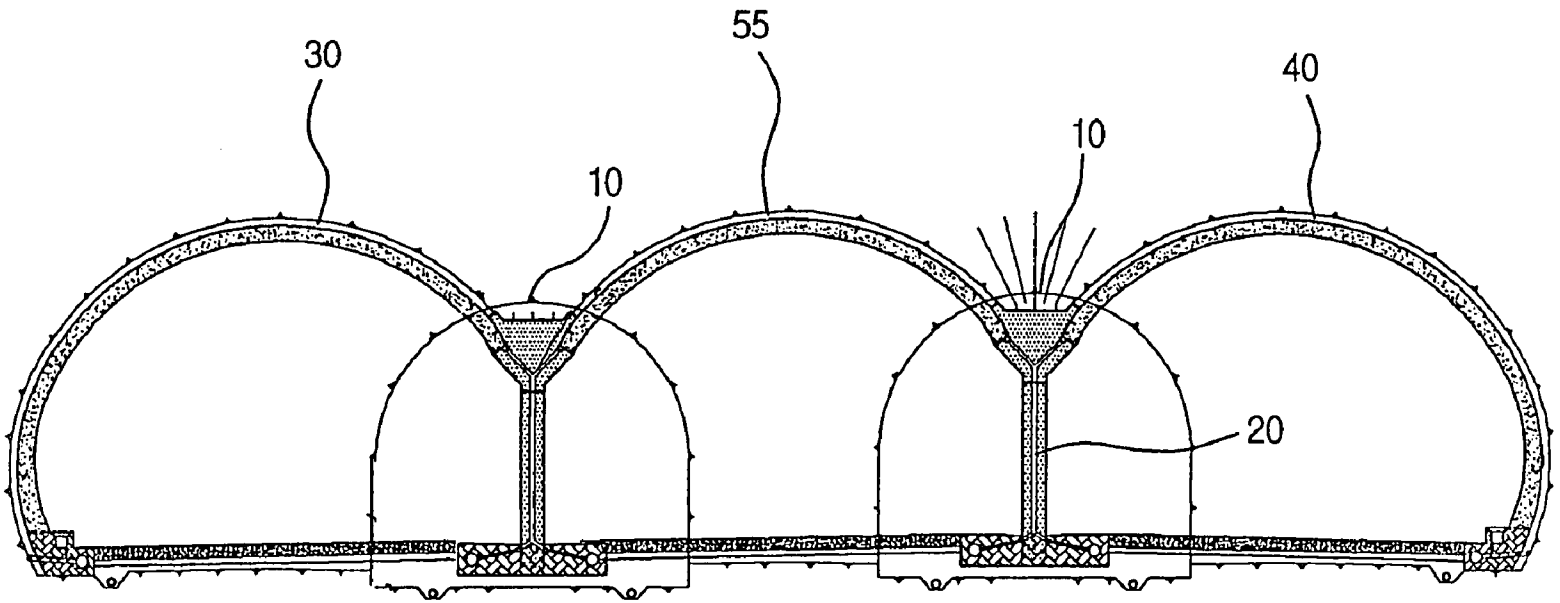
FIG. 11*a* is a schematic view of an internal drain pipe of the steel plate girder type intermediate wall having an upper fixing type structure in which the lining concrete is attached to the upper end of the intermediate wall, in accordance with the present invention.
Figure 11B:
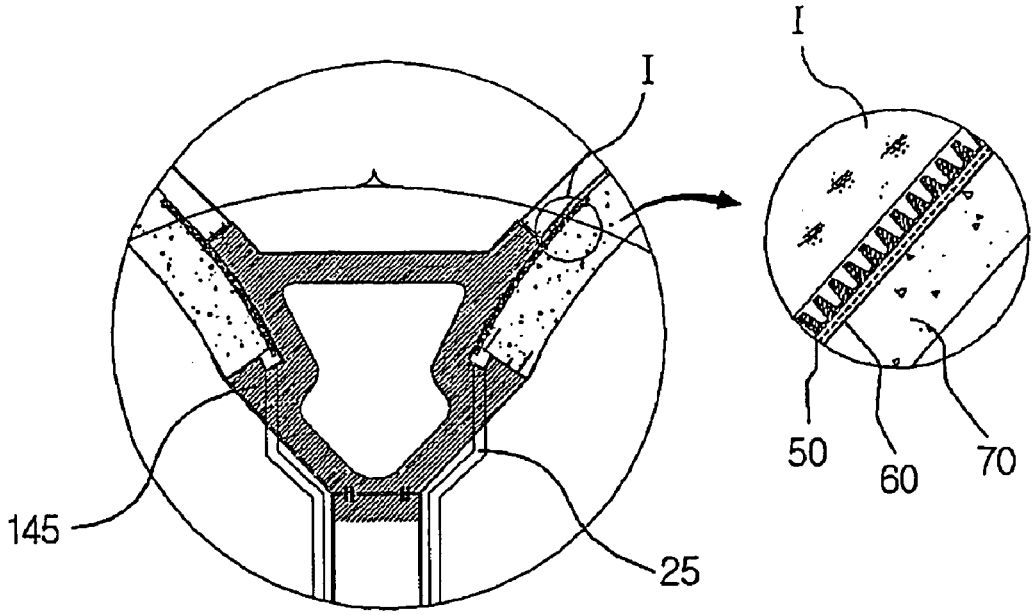
FIG. 11*b* is a schematic view of an external drain pipe of the steel plate girder type intermediate wall having an upper fixing type structure in which the lining concrete is attached to the upper end of the intermediate wall, in accordance with the present invention.
Figure 11C:
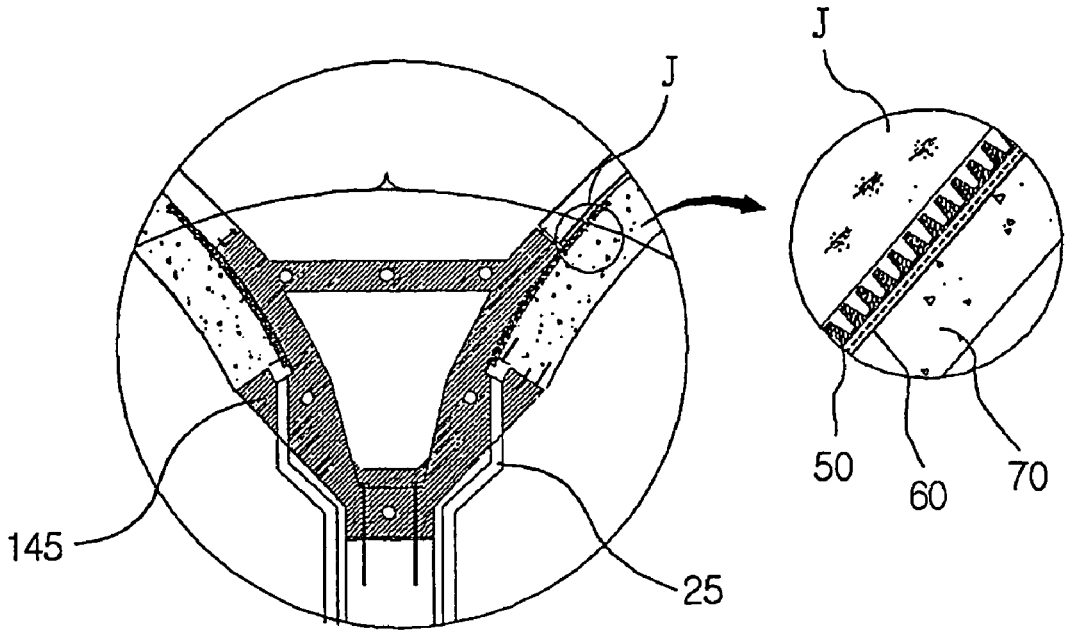
FIG. 11*c* is a schematic view of an external drain pipe of the precast concrete type intermediate wall, in accordance with the present invention.
Figure 11D:
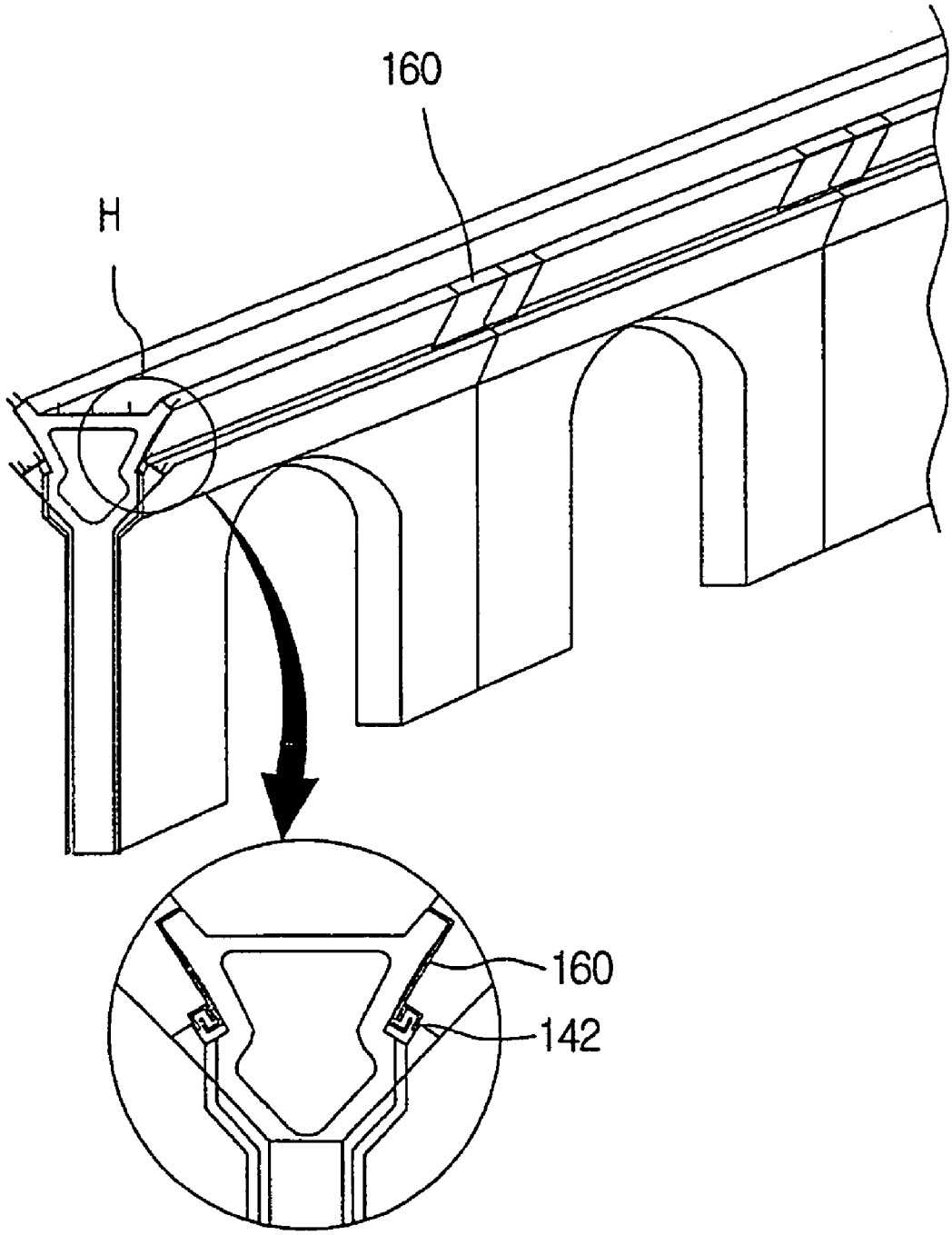
FIG. 11*d* is a schematic view illustrating drain induction iron sheets attached to a connection portion of an intermediate wall.
Figure 11E:
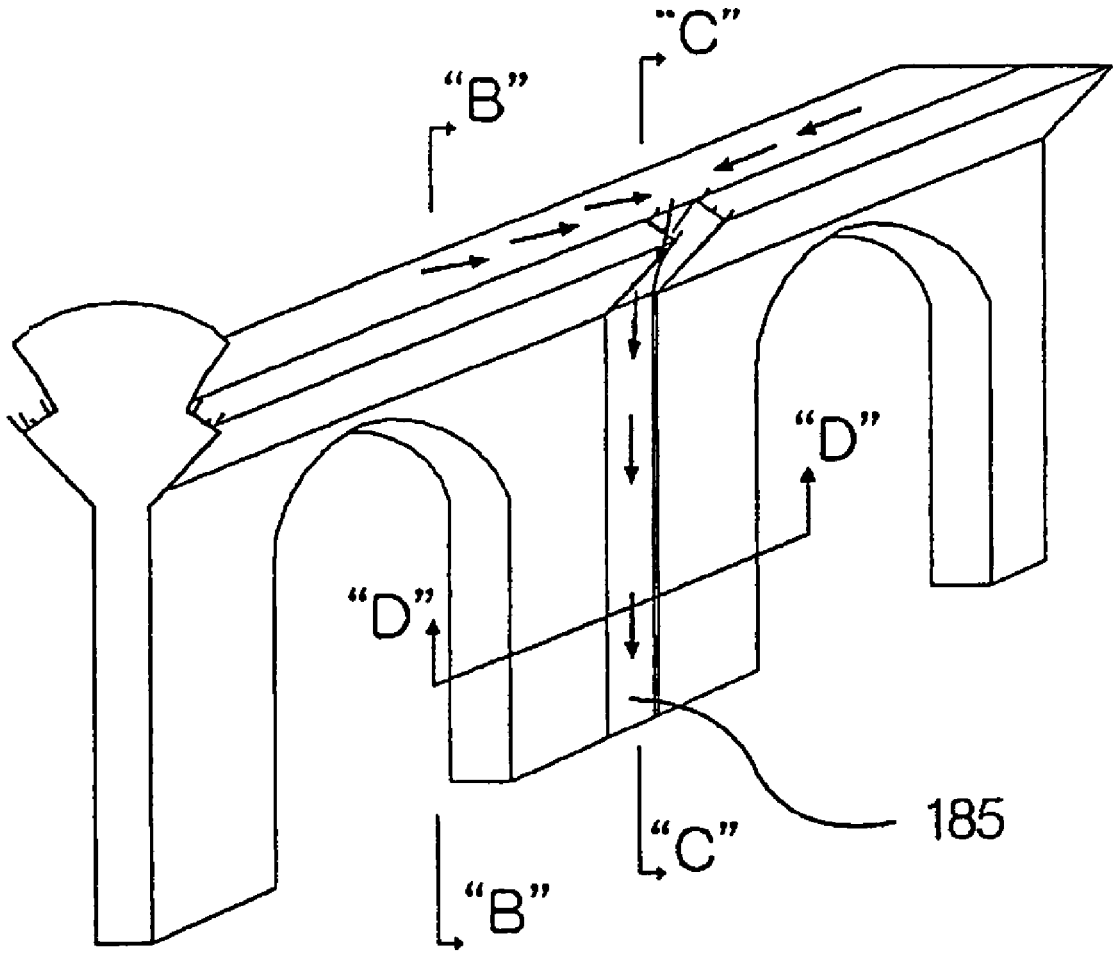
FIG. 11*e* is a schematic view illustrating a drainage system using an intermediate wall having a reduced cross-section by forming openings through the wall by constant intervals.
Figure 11F:
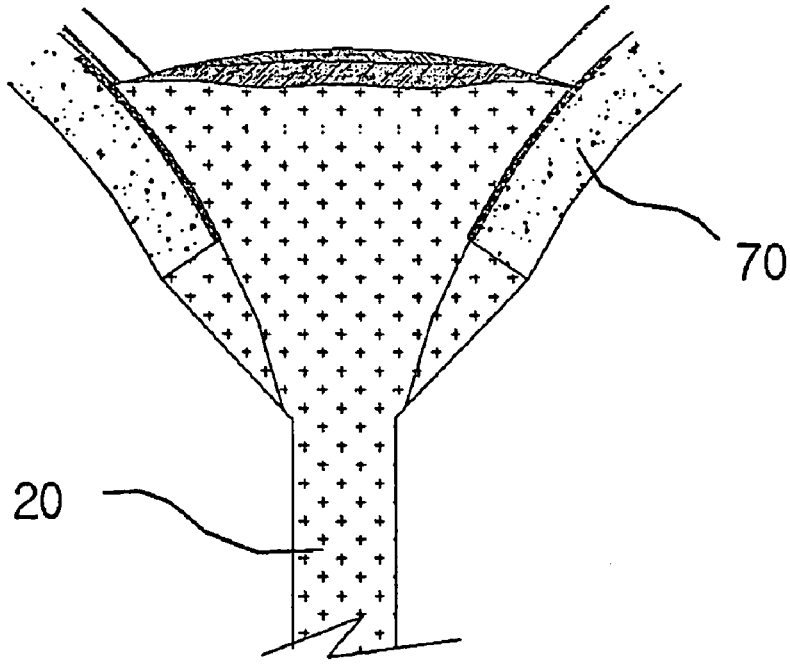
FIG. 11*f* is a cross-sectional view taken along the line B-B of FIG. 11*e;*
Figure 11G:
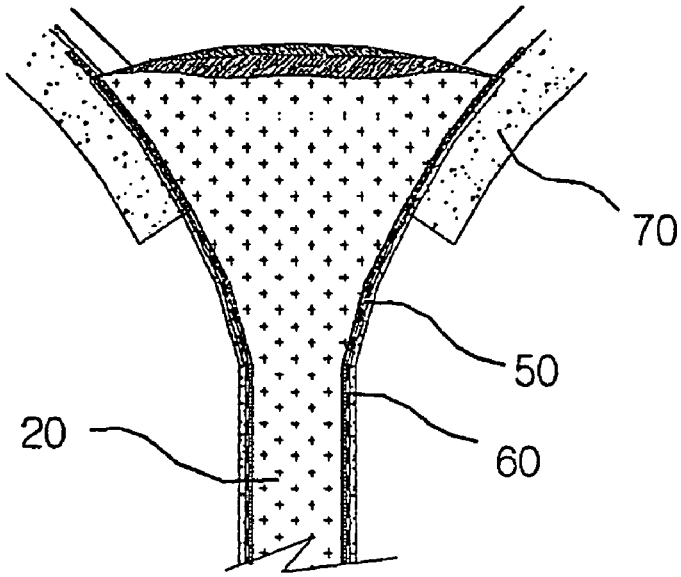
FIG. 11*g* is a cross-sectional view taken along the line C-C of FIG. 11*e;*
Figure 11H:
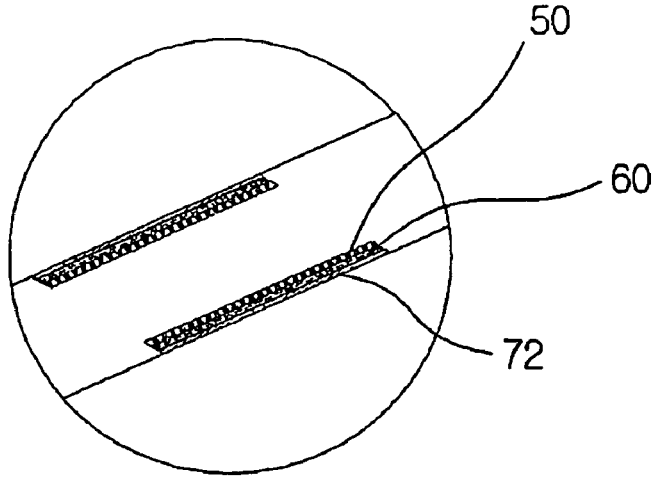
FIG. 11*h* is a cross-sectional view taken along the line D-D of FIG. 11*e;*

As shown in FIG. 11*e* illustrating a drainage system of the cast-in-place type intermediate wall 130 of which a cross section is reduced by forming openings through the intermediate wall by designated intervals, the drainage system of the cast-in-place type intermediate wall 130 is designed such that the cross section of the cast-in-place type intermediate wall 130 is locally reduced or cut such that water induced into the side surfaces of the cast-in-place type intermediate wall 130 flows along the openings 185 and then comes down.

Figure 9A:
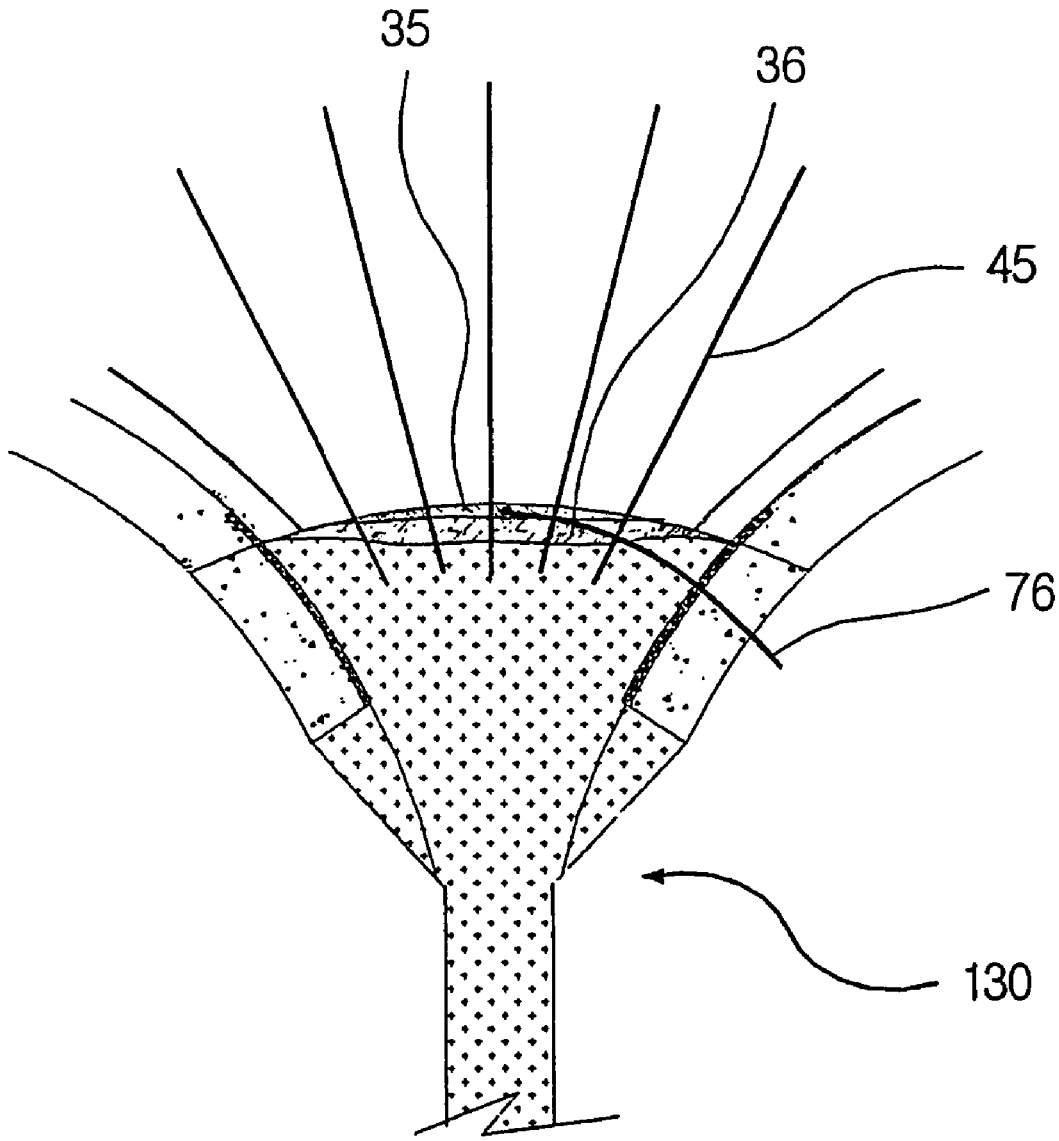
FIG. 9*a* is an enlarged cross-sectional view of a top portion of a cast-in-place type intermediate wall having an upper fixing type structure in which the lining concrete is attached to an upper end of the intermediate wall, in accordance with the present invention.
Figure 9B:
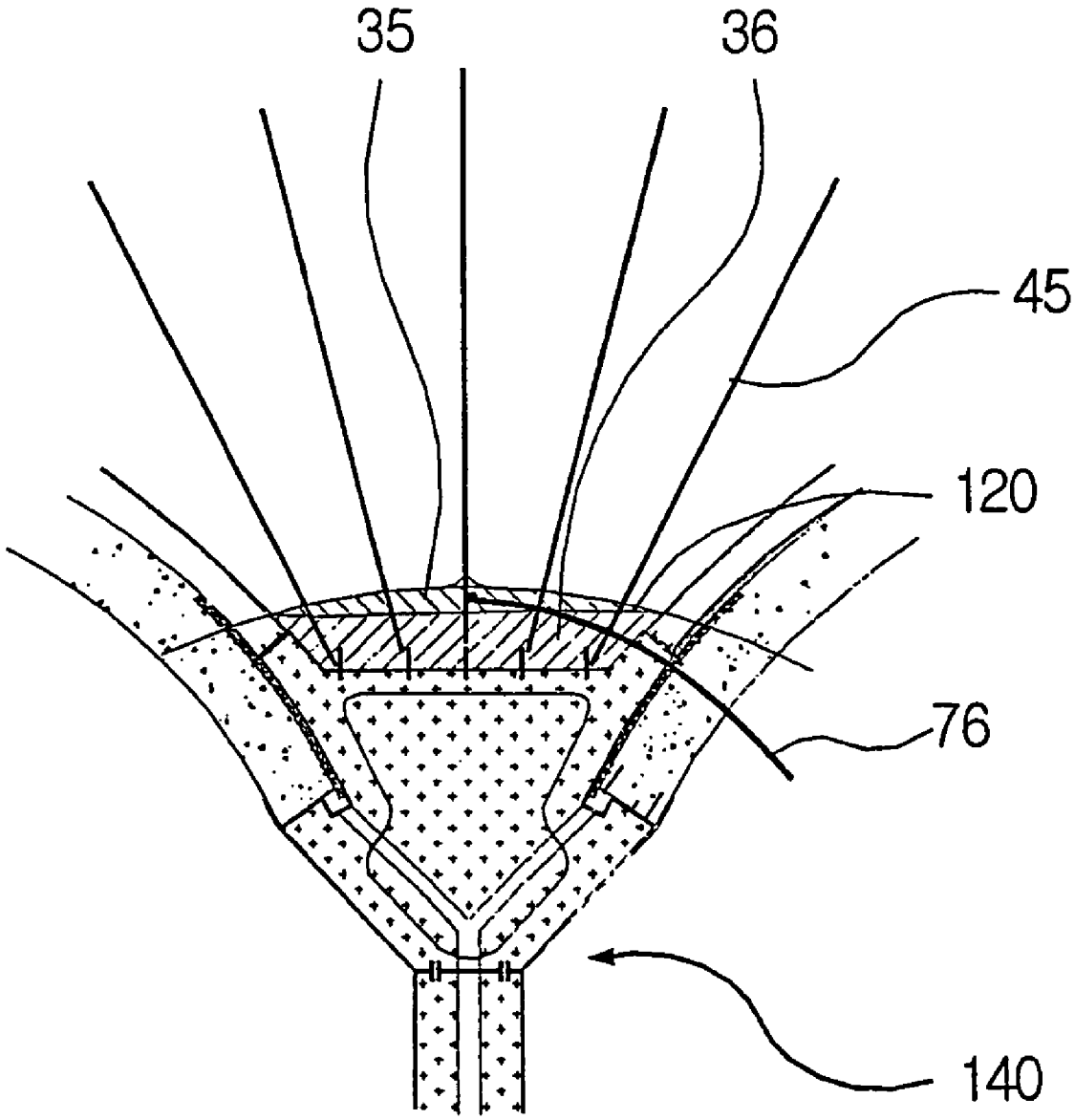
FIG. 9*b* is an enlarged cross-sectional view of a top portion of a steel plate girder type intermediate wall having an upper fixing type in which the lining concrete is attached to the upper end of the intermediate wall, in accordance with the present invention.
Figure 9C:
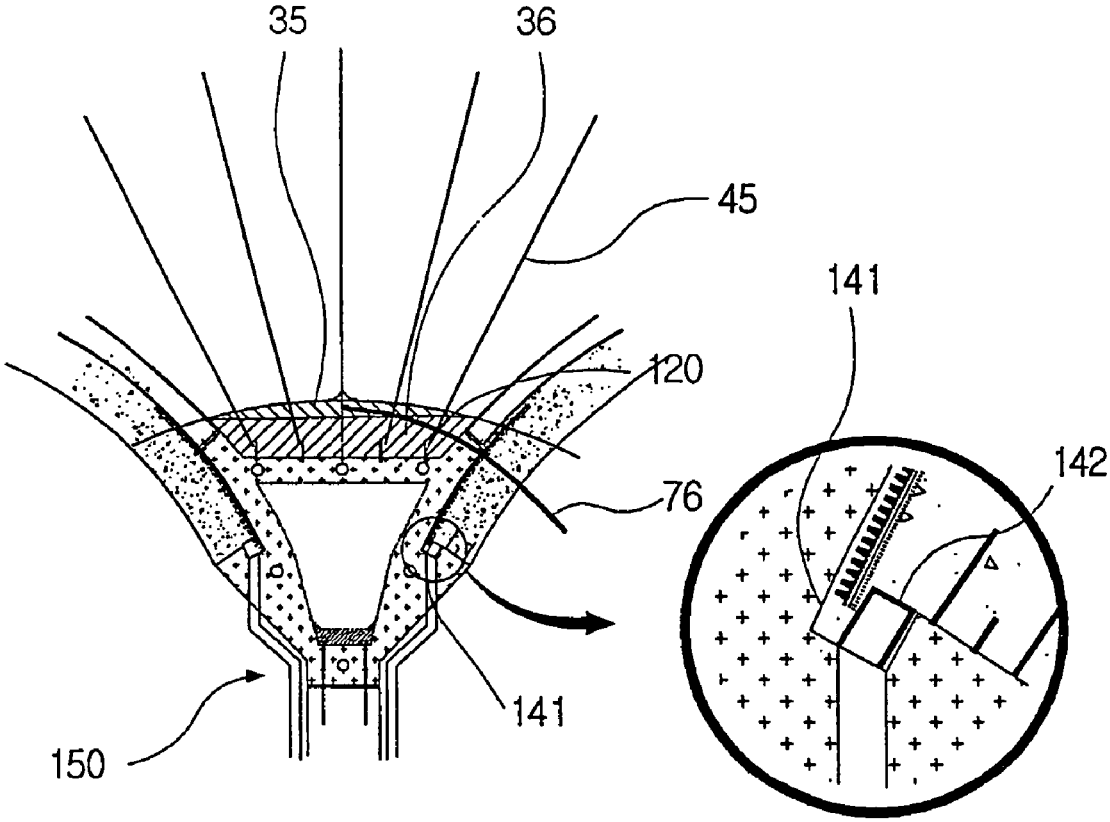
FIG. 9*c* is an enlarged cross-sectional view of a top portion of a precast concrete type intermediate wall having an upper fixing type in which the lining concrete is attached to the upper end of the intermediate wall, in accordance with the present invention.
Figure 9C:
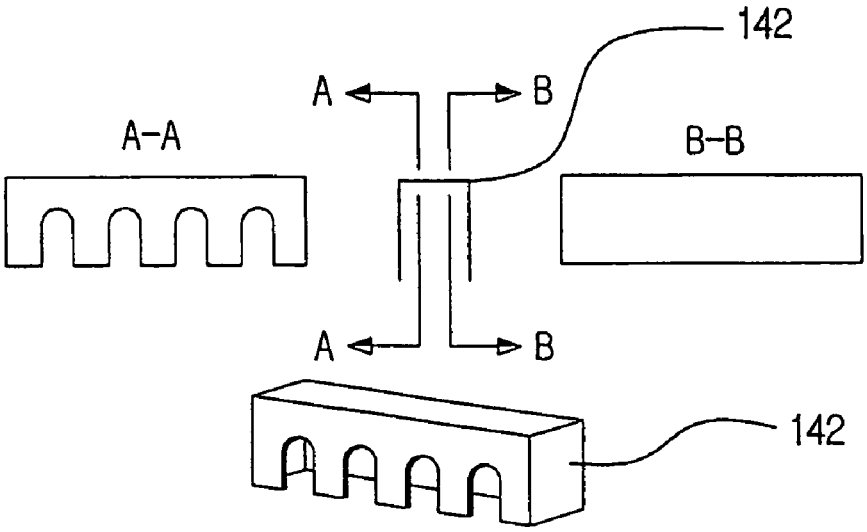
Figure 9D:
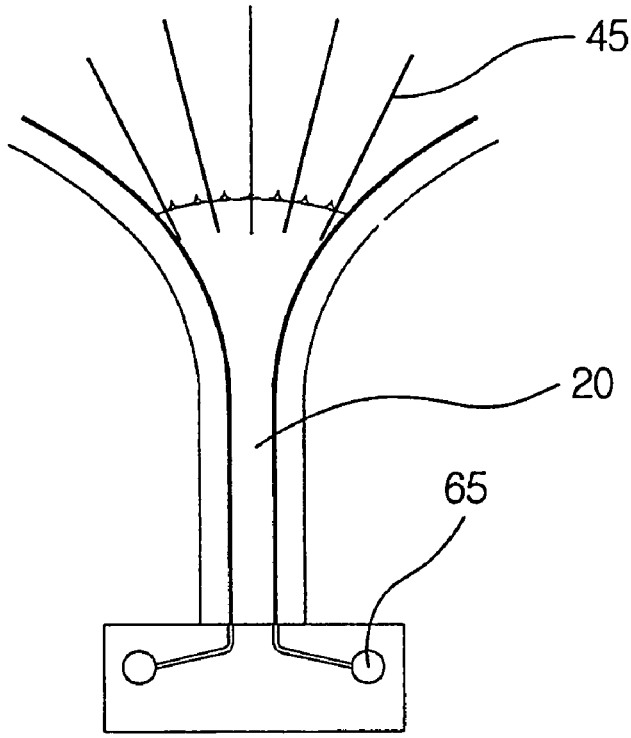
FIG. 9*d* is an enlarged cross-sectional view of a top portion of a cast-in-place type intermediate wall having a lower fixing type structure in which the lining concrete is attached to the lower end of the intermediate wall, in accordance with the present invention.

As shown in FIG. 9*a* which is an enlarged cross-sectional view of a top portion of the cast-in-place type intermediate wall, FIG. 9*b* which is an enlarged cross-sectional view of a top portion of the steel plate girder type intermediate wall, and FIG. 9*c* which is an enlarged cross-sectional view of the precast concrete type intermediate wall, the heads of the intermediate walls 130, 140 and 150 are respectively fixed to the grounds around the top portions of the intermediate walls 130, 140 and 150, thus allowing the intermediate walls 130, 140 and 150 to have an effective structure. Further, when lock bolts 45 are screwed into the top portion 180, designated portions of the lock bolts 45 having a length corresponding to the length joints are exposed in advance and then buried into the head of the intermediate walls 130, 140 and 150.

Further, studs 120 are installed in advance in the heads of the steel plate girder type intermediate wall 140 and the precast concrete type intermediate wall 150, thus firmly connecting concretes. Concrete 36 is cast into spaces formed by the exposed lock bolts 45, and the spaces are filled with mortar and a milk grouting agent 35.

Figure 12:
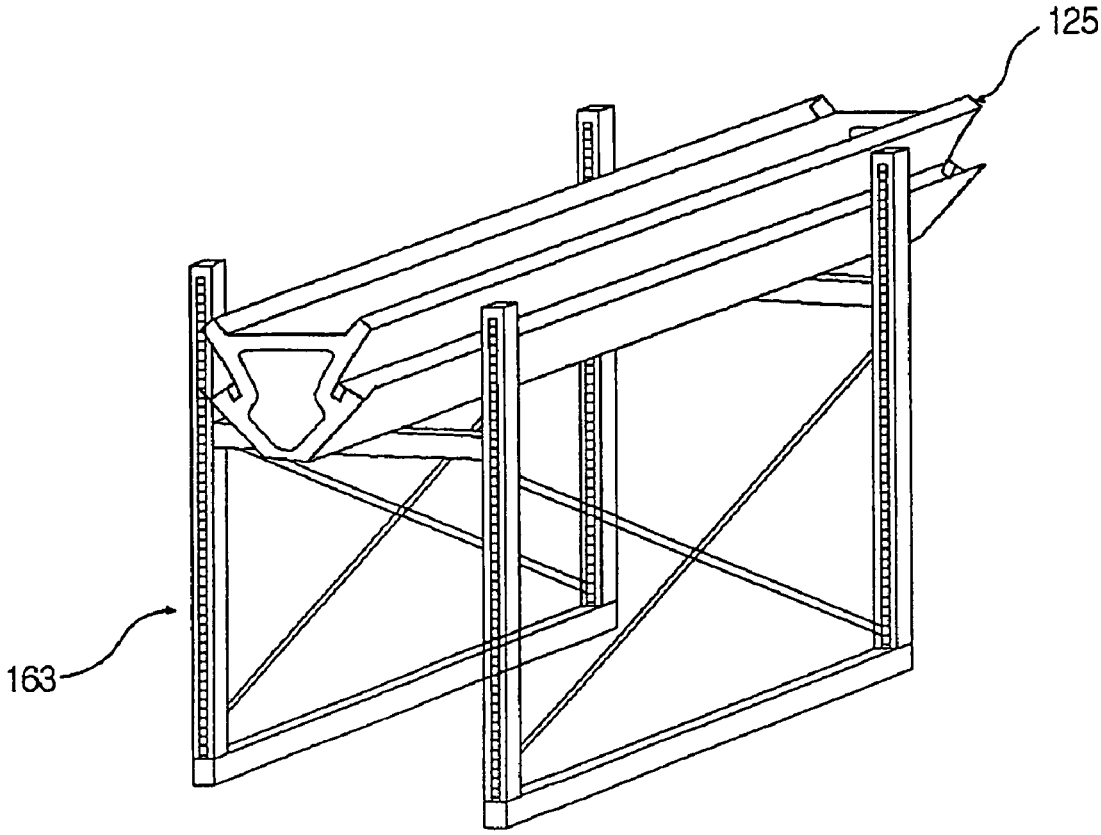
FIG. 12 is a schematic view of an apparatus for assembling a precast concrete type intermediate wall.

As shown in FIG. 12 schematically illustrating an apparatus for assembling a intermediate wall, in case that the precast concrete type intermediate wall 150 is constructed, the apparatus pulls the intermediate wall 20, which is transferred into the central tunnel (i.e., a pilot tunnel) 1, using a hydraulic lift device, and then horizontally moves the intermediate wall 20 in longitudinal and transversal directions using a holder.

Figure 13:
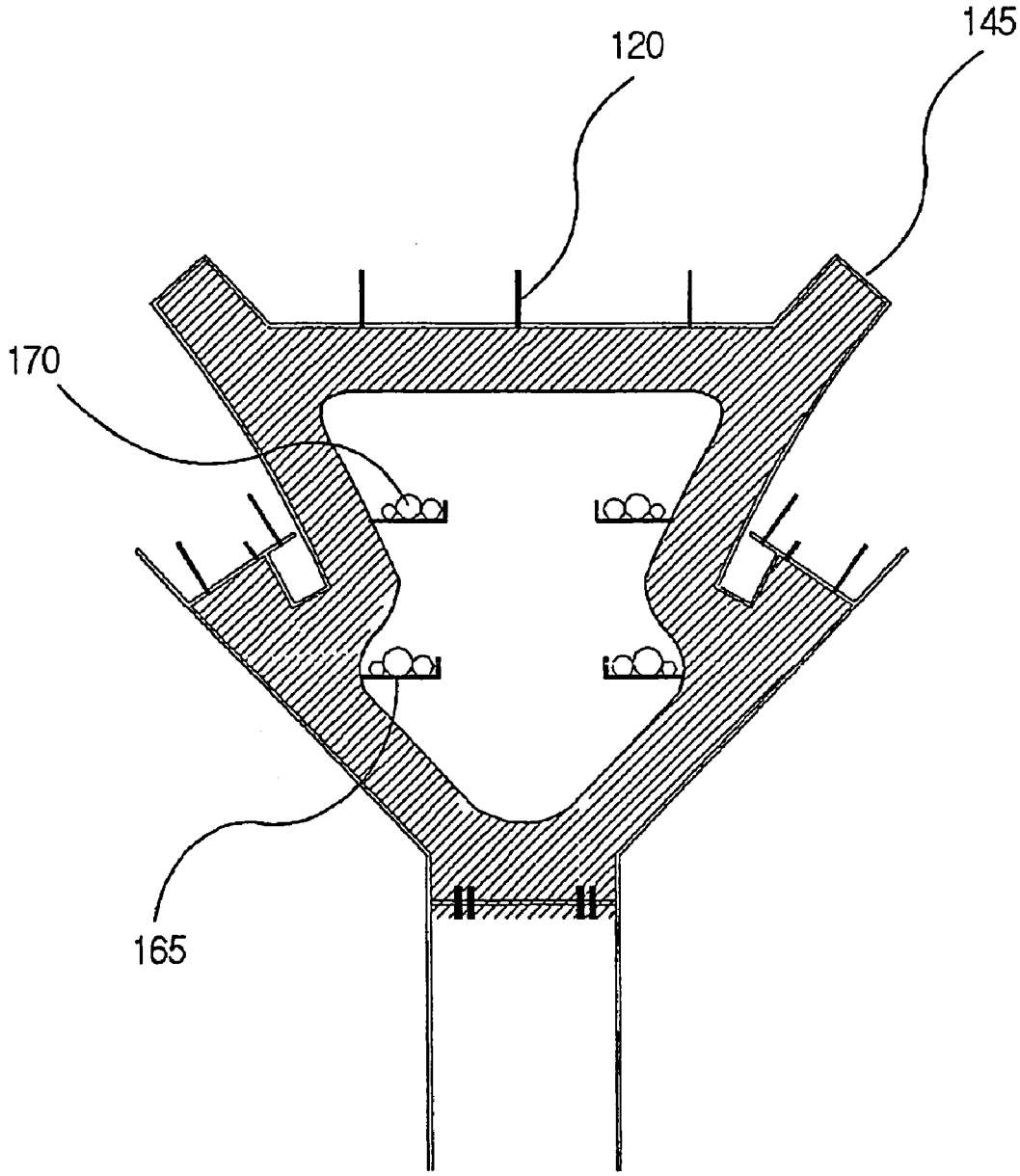
FIG. 13 is a cross-sectional view of a steel plate girder type intermediate wall provided with utility pipes, through which cables pass, and pipe holders.
Figure 14:
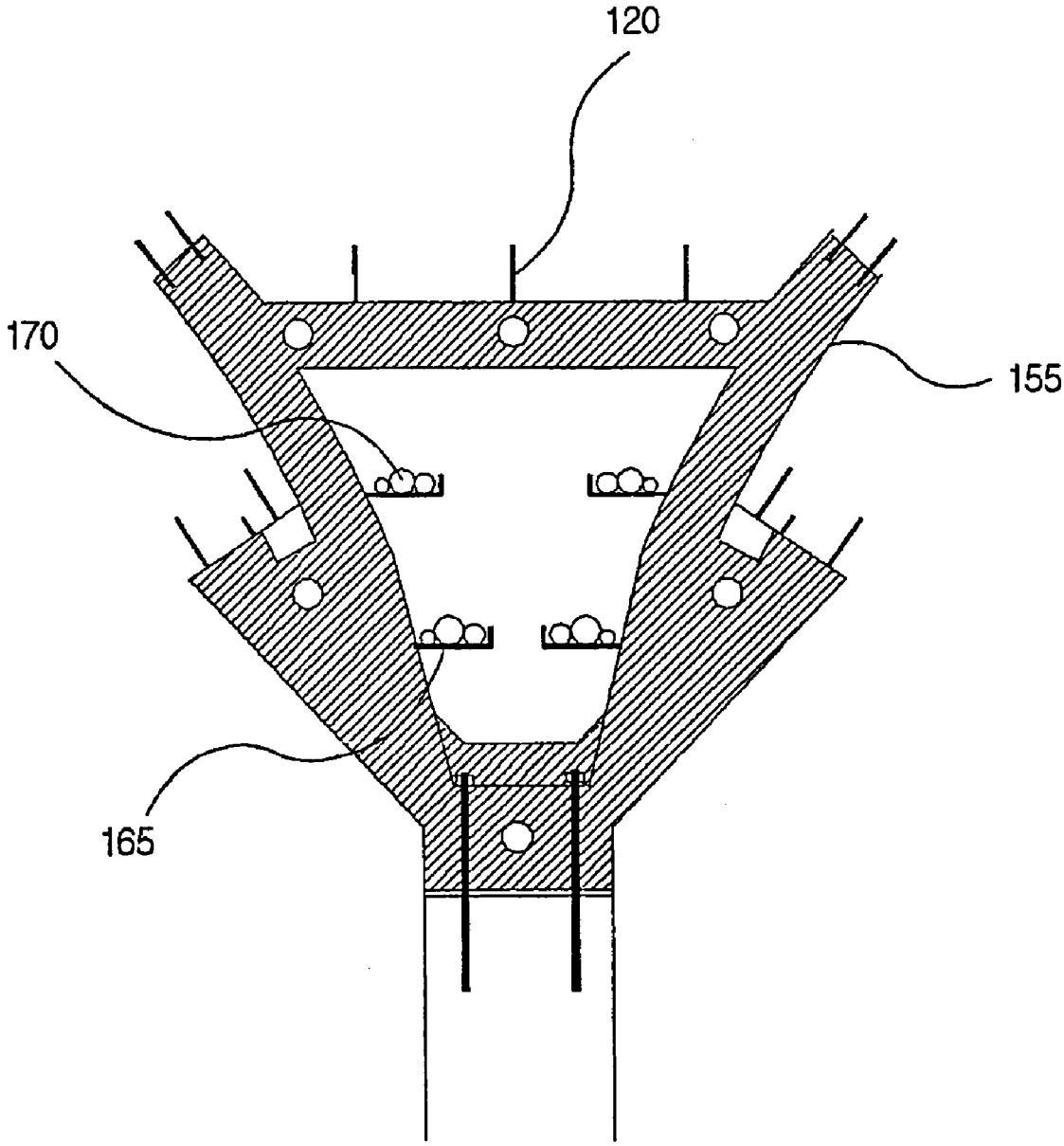
FIG. 14 is a cross-sectional view of a precast concrete type intermediate wall provided with utility pipes, through which cables pass, and pipe holders.

FIG. 13 is a cross-sectional view of a steel plate girder type intermediate wall provided with utility pipes, through which cables pass, and pipe holders, and FIG. 14 is a cross-sectional view of a precast concrete type intermediate wall provided with utility pipes, through which cables pass, and pipe holders. As shown in FIGS. 13 and 14, pipe holders 165, through which cables for communication or electric wires pass, and utility pipes 170 are installed in the steel plate girder type intermediate wall 140 and the precast concrete type intermediate wall 150, thus increasing utility of space.

Figure 15:
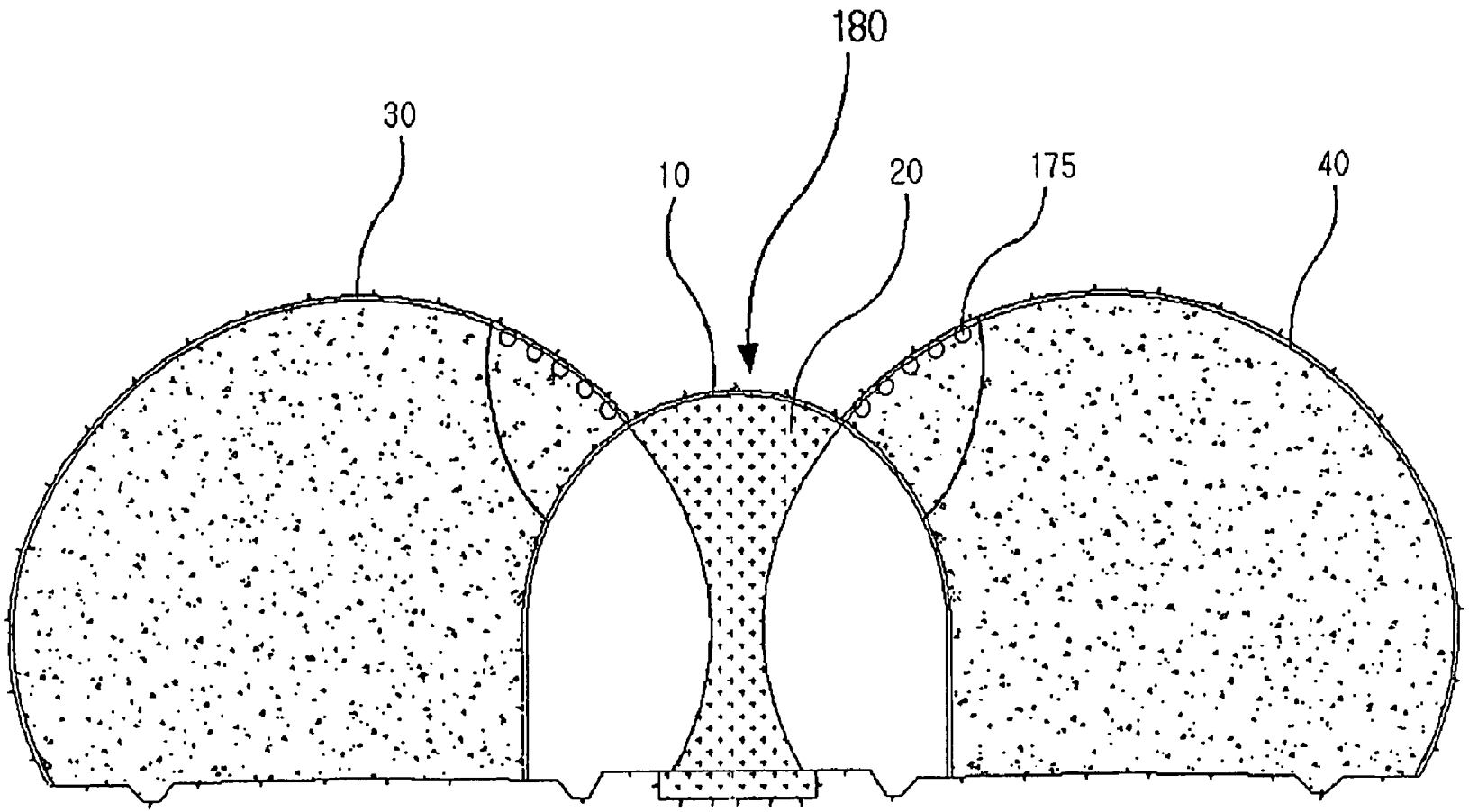
FIG. 15 is a schematic cross-sectional view of a three arch tunnel in which through holes are formed for protecting a top end of the intermediate wall, thus damping vibration when left and right main tunnels are excavated by blasting.

FIG. 15 is a schematic cross-sectional view of a three arch tunnel in which through holes are formed for damping vibration before left and right main tunnels are excavated by blasting for protecting the top portion of the intermediate wall. As shown in FIG. 15, through holes 175 are formed through the top portion 180 of the intermediate wall 20 and then the left and right main tunnels 30 and 40 are excavated by blasting, thus damping vibration and preventing the ground made of base rock around the top portion 180 from being damaged when the left and right main tunnels 30 and 40 are excavated by blasting.

INDUSTRIAL APPLICABILITY

As apparent from the above description, the present invention provides a structure of an intermediate wall of a three arch excavated tunnel, which serves as a supporting member so that a distance between two main tunnels is reduced, and a method for constructing the three arch excavated tunnel, thus remarkably reducing a size of an area of a road connected to the tunnel. Further, the intermediate wall is continuously installed together with lining concrete so that subterranean water in the ground around the intermediate wall is easily exhausted, thus solving a water leakage problem caused by a conventional tunnel (i.e., two arch tunnel).

The intermediate wall is designed such that concrete is cast by one lot each one time, thus allowing the times of concrete placement to be reduced to one-third, and continuously uses an iron mold moving along rails, thus reducing construction period and construction cost.

Further, a protective wire netting frame for protecting the intermediate wall in excavating main tunnels is applied to the rails in placing concrete for the intermediate wall, thus reducing construction period and construction cost.

That is, a top portion of the intermediate wall penetrating a ceiling of a central tunnel is fixed, thus damping vibration generated in excavating the main tunnels by blasting. Further, the main tunnel constructed by one excavation has a long length, thus reducing construction cost taken to excavate the tunnel and increasing stability of a structure of the tunnel during construction. Moreover, the construction method of the present invention omits a step of forming a waterproof member on the ceiling portion of the central tunnel, thus reducing construction period and construction cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method for constructing an intermediate wall, having an upper fixing type structure, of a three arch excavated tunnel, in which lining concrete is cast and fixed to an upper side of the intermediate wall, a lower portion of the intermediate wall has a small thickness reduced as much as the thickness of the lining concrete, and the lower portion of the intermediate wall is one type selected from the group consisting of a column type, an arch type and an intermediate wall type, the intermediate wall having the upper fixing type structure being one selected from the group consisting of a cast-in-place type intermediate wall, a steel plate girder type intermediate wall and a precast concrete type intermediate wall, the steel plate girder type or the precast concrete type intermediate wall has a drainage system in which a portion of the intermediate wall extending into a central tunnel of the three arch excavated tunnel is filled with a grouting agent without application of a waterproofing step, and an upper portion of the intermediate wall is drained such that water is induced toward side walls of the intermediate wall using a drain board and a waterproof layer and then sequentially flows toward the inside of the intermediate wall along a collection tank stopper, a collection tank and drain pipes.

2. The method as set forth in claim 1, wherein the steel plate girder type intermediate wall has a drainage system in which the intermediate wall is formed to drain water such that water from the intermediate wall sequentially flows toward the outside of the intermediate wall along a collection tank stopper, a collection tank and drain pipes.

3. The method as set forth in claim 1,wherein the cast-in-place type intermediate wall has a drainage system in which a cross section of the intermediate wall is locally reduced or cut forming openings so that water induced into the side surfaces of the cast-in-place type intermediate wall from the upper side of the cast-in-place type intermediate wall flows along the openings and down the side surfaces.

4. The method as set forth in claim 1, wherein a head of the intermediate wall is respectively fixed to the ground around a top portion of the intermediate wall extending into a central tunnel of the three arch excavated tunnel, and designated portions of lock bolts have a length corresponding to a length that joints are exposed with respect to the head before the designated portions of the lock bolts are buried into the head of the intermediate wall when the lock bolts are screwed into the top portion of the intermediate wall, the lock bolts fixing the intermediate wall to the ground around the top portion of the intermediate wall.

5. The method as set forth in claim 1, wherein studs are installed in advance in a head of the steel plate girder type or the precast concrete type intermediate wall, concrete is cast into spaces formed by lock bolts, which fix the intermediate wall to ground around a top portion of the intermediate wall, the spaces being filled with mortar and a milk grouting agent.

6. The method as set forth in claim 1, wherein pipe holders and utility pipes are installed in the steel plate girder type or precast concrete type intermediate wall, thus allowing cables for communication and electric wires to pass through the intermediate wall.

7. A method for constructing an intermediate wall, having an upper fixing type structure, of a three arch excavated tunnel, in which lining concrete is cast and fixed to an upper side of the intermediate wall, a lower portion of the intermediate wall has a small thickness reduced as much as the thickness of the lining concrete, and the lower portion of the intermediate wall is one type selected from the group consisting of a column type, an arch type and an intermediate wall type, the intermediate wall having the upper fixing type structure is one selected from the group consisting of a cast-in-place type intermediate wall, a steel plate girder type intermediate wall and a precast concrete type intermediate wall, the steel plate girder type intermediate wall has a drainage system in which the intermediate wall is formed to drain water such that water from the intermediate wall sequentially flows toward the outside of the intermediate wall along a collection tank stopper, a collection tank and drain pipes.

8. The method as set forth in claim 7, wherein a head of the intermediate wall is respectively fixed to the ground around a top portion of the intermediate wall extending into a central tunnel of the three arch excavated tunnel, and designated portions of lock bolts have a length corresponding to a length that joints are exposed with respect to the head before the designated portions of the lock bolts are buried into the head of the intermediate wall when the lock bolts are screwed into the top portion of the intermediate wall, the lock bolts fixing the intermediate wall to the ground around the top portion of the intermediate wall.

9. The method as set forth in claim 7, wherein studs are installed in advance in a head of the steel plate girder type or the precast concrete type intermediate wall, concrete is cast into spaces formed by lock bolts, which fix the intermediate wall to ground around a top portion of the intermediate wall, the spaces being filled with mortar and a milk grouting agent.

10. The method as set forth in claim 7, wherein pipe holders and utility pipes are installed in the steel plate girder type or precast concrete type intermediate wall, thus allowing cables for communication and electric wires to pass through the intermediate wall.

11. The method as set forth in claim 10, wherein a head of the intermediate wall is respectively fixed to the ground around a top portion of the intermediate wall extending into a central tunnel of the three arch excavated tunnel, and designated portions of lock bolts have a length corresponding to a length that joints are exposed with respect to the head before the designated portions of the lock bolts are buried into the head of the intermediate wall when the lock bolts are screwed into the top portion of the intermediate wall, the lock bolts fixing the intermediate wall to the ground around the top portion of the intermediate wall.

12. A method for constructing an intermediate wall, having an upper fixing type structure, of a three arch excavated tunnel, in which lining concrete is cast and fixed to an upper side of the intermediate wall, a lower portion of the intermediate wall has a small thickness reduced as much as the thickness of the lining concrete, and the lower portion of the intermediate wall is one type selected from the group consisting of a column type, an arch type and an intermediate wall type, the intermediate wall having the upper fixing type structure is one selected from the group consisting of a cast-in-place type intermediate wall, a steel plate girder type intermediate wall and a precast concrete type intermediate wall, the cast-in-place type intermediate wall has a drainage system in which a cross section of the intermediate wall is locally reduced or cut forming openings so that water induced into the side surfaces of the cast-in-place type intermediate wall from the upper side of the cast-in-place type intermediate wall flows along the openings and down the side surfaces.

13. A method for constructing an intermediate wall, having an upper fixing type structure, of a three arch excavated tunnel, in which lining concrete is cast and fixed to an upper side of the intermediate wall, a lower portion of the intermediate wall has a small thickness reduced as much as the thickness of the lining concrete, and the lower portion of the intermediate wall is one type selected from the group consisting of a column type, an arch type and an intermediate wall type, the intermediate wall having the upper fixing type structure being one selected from the group consisting of a cast-in-place type intermediate wall, a steel plate girder type intermediate wall and a precast concrete type intermediate wall, a head of the intermediate wall is respectively fixed to the ground around a top portion of the intermediate wall extending into a central tunnel of the three arch excavated tunnel, and designated portions of lock bolts have a length corresponding to a length that joints are exposed with respect to the head before the designated portions of the lock bolts are buried into the head of the intermediate wall when the lock bolts are screwed into the top portion of the intermediate wall, the lock bolts fixing the intermediate wall to the ground around the top portion of the intermediate wall.

14. A method for constructing an intermediate wall, having an upper fixing type structure, of a three arch excavated tunnel, in which lining concrete is cast and fixed to an upper side of the intermediate wall, a lower portion of the intermediate wall has a small thickness reduced as much as the thickness of the lining concrete, and the lower portion of the intermediate wall is one type selected from the group consisting of a column type, an arch type and an intermediate wall type, the intermediate wall having the upper fixing type structure being one selected from the group consisting of a cast-in-place type intermediate wall, a steel plate girder type intermediate wall and a precast concrete type intermediate wall, studs being installed in advance in a head of the steel plate girder type or the precast concrete type intermediate wall, concrete is cast into spaces formed by lock bolts, which fix the intermediate wall to ground around a top portion of the intermediate wall, the spaces being filled with mortar and a milk grouting agent.

* * * * *